US009829857B2

(12) United States Patent
Yada et al.

(10) Patent No.: US 9,829,857 B2
(45) Date of Patent: Nov. 28, 2017

(54) IMAGE FORMING APPARATUS INCLUDING AN ERRONEOUS ATTACHING PREVENTION UNIT

(71) Applicant: CANON KABUSHIKI KAISHA, Tokyo (JP)

(72) Inventors: Takayuki Yada, Suntou-gun (JP); Toru Oguma, Mishima (JP); Hiroaki Nosho, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/880,470

(22) Filed: Oct. 12, 2015

(65) Prior Publication Data

US 2016/0103418 A1 Apr. 14, 2016

(30) Foreign Application Priority Data

Oct. 14, 2014 (JP) ..... 2014-210226

(51) Int. Cl.
*G03G 21/18* (2006.01)

(52) U.S. Cl.
CPC ..... *G03G 21/1842* (2013.01); *G03G 21/1853* (2013.01); *G03G 2221/1684* (2013.01); *G03G 2221/1869* (2013.01); *G03G 2221/1884* (2013.01)

(58) Field of Classification Search
CPC ..... G03G 21/1842; G03G 21/1853; G03G 2221/1684; G03G 2221/1654; G03G 2221/1869; G03G 2221/1884
See application file for complete search history.

(56) References Cited

U.S. PATENT DOCUMENTS

2007/0147889 A1* 6/2007 Kamimura ..... G03G 15/0813 399/119
2014/0086628 A1* 3/2014 Toriyama ..... G03G 21/1853 399/111

FOREIGN PATENT DOCUMENTS

JP 2014-66794 A 4/2014

* cited by examiner

*Primary Examiner* — David M Gray
*Assistant Examiner* — Michael Harrison
(74) *Attorney, Agent, or Firm* — Canon U.S.A., Inc. IP Division

(57) ABSTRACT

An image forming apparatus in which a cartridge including an erroneous attaching prevention unit and a protruding portion as a holding unit, can be inserted to an attached position. The image forming apparatus includes a frame, an inclined surface on which the protruding portion is placed, the inclined surface being provided to the frame, a guide portion defining with the inclined surface a gap through which the protruding portion is able to pass, and a movable member configured to engage with the erroneous attaching prevention unit on a downstream side of the guide portion in an insertion direction.

14 Claims, 23 Drawing Sheets

IMAGE FORMING APPARATUS INCLUDING AN ERRONEOUS ATTACHING PREVENTION UNIT

BACKGROUND OF THE INVENTION

Field of the Invention

The present invention relates to an image forming apparatus using a cartridge.

Description of the Related Art

Electrophotographic image forming apparatuses (hereinafter, referred to as "image forming apparatuses") perform image recoding in the following manner. An electrophotographic photosensitive member, that is, a photosensitive drum used as an image bearing member is uniformly charged. The charged photosensitive drum is selectively exposed with light, so that an electrostatic latent image (electrostatic image) is formed on the photosensitive drum. Then, the electrostatic latent image formed on the photosensitive drum is developed with toner used as a developer to form a toner image. The toner image formed on the photosensitive drum is transferred onto a recording material such as recording paper or a plastic sheet. Heat and pressure are applied to the toner image which has been transferred onto the recording material to fix the toner image on the recording material.

Generally, such image forming apparatuses require toner supply and maintenance of a process unit. A process cartridge has been in practical use to easily perform the toner supply and the maintenance of the process unit. The process cartridge includes the photosensitive drum, a charging unit, a developing unit, a cleaning unit, and the like which are integrated in a frame. The process cartridge is detachably attached to a main body of an image forming apparatus.

With the process cartridge system, a user can perform the maintenance of the apparatus by themselves. Thus, an image forming apparatus with excellent operability and usability can be provided. Accordingly, the process cartridge system is widely used in the image forming apparatuses.

However, in the image forming apparatus employing such a cartridge system, the cartridge may be erroneously inserted. More specifically, not only a cartridge compatible with the image forming apparatus main body, but also a cartridge incompatible with the image forming apparatus main body might be attached to a cartridge attachment portion in the image forming apparatus main body. The cartridge compatible with the image forming apparatus main body is a cartridge which matches a product model, for example. The cartridges compatible with and incompatible with the image forming apparatus main body are hereinafter respectively referred to as a compatible cartridge and an incompatible cartridge.

One of the methods developed to prevent the erroneous insertion of the incompatible cartridge is discussed in Japanese Patent Application Laid-Open No. 2014-66794. In this method, a boss provided in the incompatible cartridge cannot engage with a movable board disposed adjacent to an opening of the image forming apparatus main body when the incompatible cartridge is inserted to the image forming apparatus main body. More specifically, the above-described configuration includes the movable board having an engaging portion. The movable board engages with the boss of the compatible cartridge while the movable board interferes with the boss of the incompatible cartridge to prevent the further insertion of the incompatible cartridge.

SUMMARY OF THE INVENTION

An image forming apparatus according to an aspect of the present invention in which a cartridge including an erroneous attaching prevention unit and a protruding portion as a holding unit can be inserted to an attached position, the image forming apparatus includes a frame, an inclined surface provided in the frame on which the protruding portion is placed, a guide portion defining with the inclined surface, a gap through which the protruding portion is able to pass, and a movable member configured to engage with the erroneous attaching prevention unit on a downstream side of the guide portion in an insertion direction.

Further features of the present invention will become apparent from the following description of exemplary embodiments with reference to the attached drawings.

DESCRIPTION OF THE EMBODIMENTS

A first exemplary embodiment of the present invention is described below. A configuration according to the first exemplary embodiment of the present invention is described in detail with reference to drawings.

The image forming apparatus described below forms an image on a recording medium using an electrophotography image forming system. Examples of the image forming apparatus include an electrophotographic copying machine, an electrophotographic printer (such as a light emitting diode (LED) printer or a laser beam printer), a facsimile apparatus, and a word processor. A process cartridge is formed by integrating an electrophotographic photosensitive member with at least one of a charging unit, a developing unit, and a cleaning unit serving as process units that perform processing on the electrophotographic photosensitive member, as a single cartridge. The cartridge is detachably attached to a main body of the image forming apparatus. For example, an image bearing member (hereinafter, referred to as a photosensitive drum), and at least one of the developing unit, the charging unit, and the cleaning unit serving as the process units, are integrally formed as a single cartridge. In the configuration according to the present exemplary embodiment, the process cartridge includes at least the cleaning unit.

In the description given below, the rotational axis direction of the photosensitive drum is defined as a longitudinal direction. In the longitudinal direction, a side on which the photosensitive drum receives driving force from an image forming apparatus main body is referred to as a driving side, and a side opposite to the driving side is referred to as a non-driving side. In the present embodiment, a laser beam printer employing electrophotography technique and having a cartridge A detachably attached to a main body of the image forming apparatus (hereinafter, referred to as an apparatus main body G), is described as an example of the image forming apparatus. The apparatus main body G is a portion of the electrophotographic image forming apparatus from which the cartridge A is excluded.

<Overall Configuration of Image Forming Apparatus>

Figure 2:
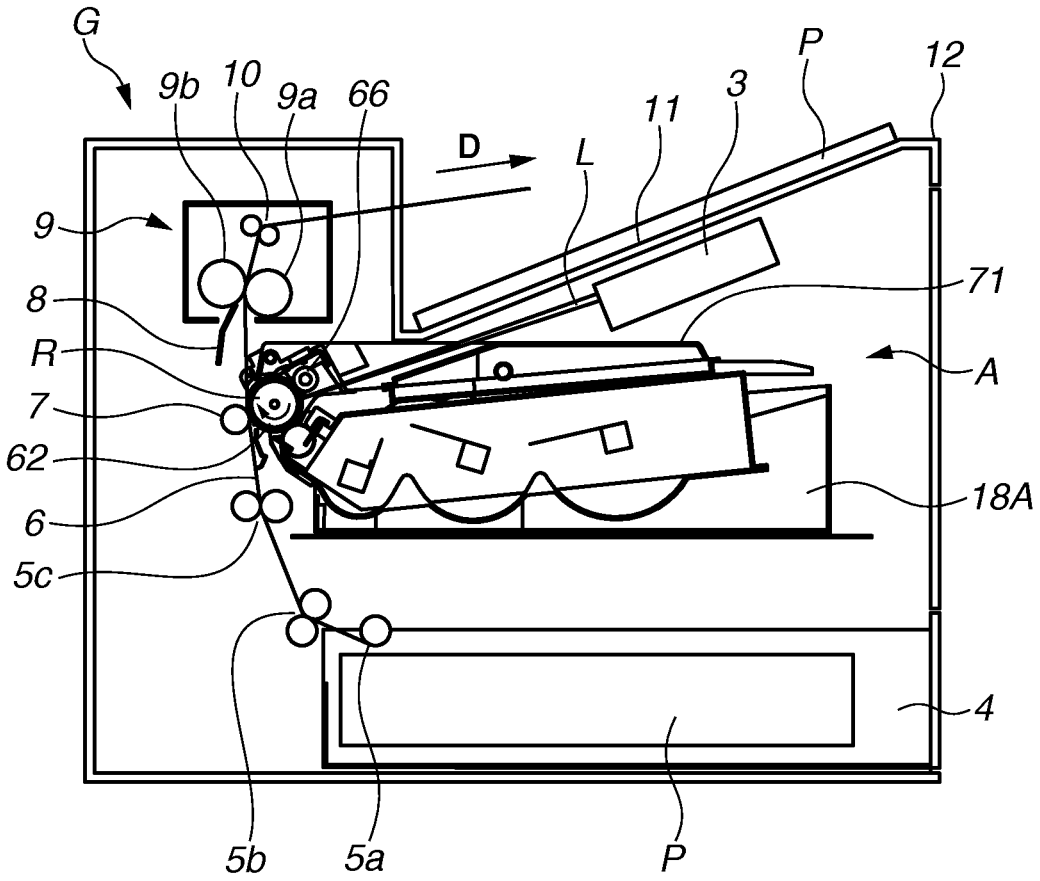
FIG. 2 is a cross-sectional view of an image forming apparatus main body and a cartridge according to the first exemplary embodiment.
Figure 3:
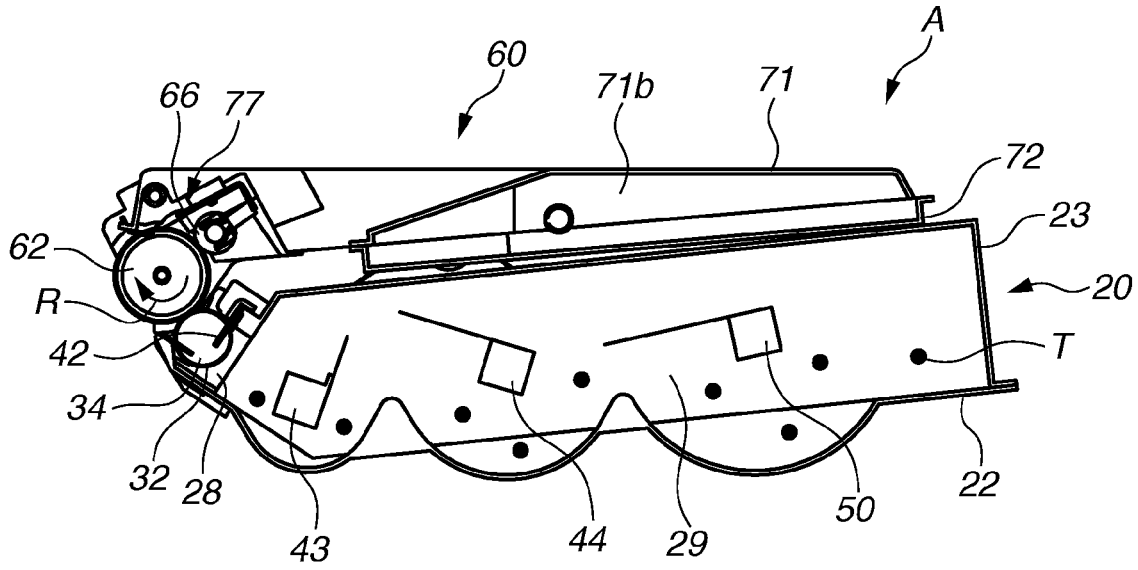
FIG. 3 is a cross-sectional view of the cartridge according to the first exemplary embodiment.

FIG. 2 is a cross-sectional view of the main body G of the image forming apparatus and the cartridge A according to the first exemplary embodiment of the present invention. FIG. 3 is a cross-sectional view of the cartridge A. When the cartridge A is attached to the apparatus main body G, an exposure device 3 (laser scanner unit) is disposed at a position facing a photosensitive drum 62 serving as an image bearing member of the cartridge A. A sheet tray 4 containing a recording medium (hereinafter, referred to as a sheet member P) as an image forming target is disposed below the cartridge A.

In the apparatus main body G, a pickup roller 5*a*, a pair of feed rollers 5*b*, a pair of conveyance rollers 5*c*, a transfer guide 6, a transfer roller 7, a conveyance guide 8, a fixing device 9, a pair of discharge rollers 10, a discharge tray 11, and the like are arranged, in this order in a conveyance direction D of the sheet member P, in a frame 12. The fixing device 9 includes a heating roller 9*a* and a pressing roller 9*b*.

<Image Forming Process>

Next, an overview of an image forming process is described with reference to FIG. 2. The photosensitive drum 62 is driven to rotate at a predetermined circumferential speed (process speed) in a direction indicated by an arrow R, in response to a print start signal. A charging roller 66, to which bias voltage is applied, is brought into contact with an outer circumference surface of the photosensitive drum 62, so that the outer circumference surface of the photosensitive drum 62 is uniformly charged. The exposure device 3 outputs a laser beam L corresponding to image information. Thus, the outer circumference surface of the photosensitive drum 62 is scanned and exposed with the laser beam, and an electrostatic latent image corresponding to the image information is formed on the outer circumference surface of the photosensitive drum 62.

Meanwhile, as illustrated in FIG. 3, in a developing unit 20 serving as a developing device, first to third conveyance members 43, 44, and 50 rotate to stir and convey the developer (toner T) in a toner chamber 29, and to send the toner T to a toner supply chamber 28. The toner T is carried on a circumference surface of a development roller 32 while being frictionally charged by a development blade 42. The development blade 42 regulates a toner layer thickness to a certain level. The toner T is transferred onto the photosensitive drum 62 in accordance with the electrostatic latent image to be visualized as a toner image.

As illustrated in FIG. 2, the pickup roller 5*a*, the pair of feed rollers 5*b*, and the pair of conveyance rollers 5*c* convey the sheet member P stored in a lower portion of the apparatus main body G from the sheet tray 4 in time with output of the laser beam L. The sheet member P is conveyed to a transfer position between the photosensitive drum 62 and the transfer roller 7 through the transfer guide 6. At the transfer position, the toner images are sequentially transferred onto the sheet member P from the photosensitive drum 62.

The sheet member P, onto which the toner image has been transferred, is separated from the photosensitive drum 62, and is conveyed to the fixing device 9 along the conveyance guide 8. Then, the sheet member P passes through a nip portion between the heating roller 9*a* and the pressing roller 9*b*, which constitute the fixing device 9. Through heating and pressing processing at the nip portion, the toner image is fixed on the sheet member P. The sheet member P, after the processing for fixing the toner image, is conveyed to the pair of discharge rollers 10 to be discharged onto the discharge tray 11.

As illustrated in FIG. 3, the photosensitive drum 62 after the transfer has residual toner on the outer circumference surface, which is removed by a cleaning blade 77, and is used for the image forming process again. The toner removed from the photosensitive drum 62 is stored in a waste toner chamber 71*b* of a cleaning unit 60. In the above description, the charging roller 66, the development roller 32, the transfer roller 7, and the cleaning blade 77 are the process units that work on the photosensitive drum 62.

<Overall Configuration of Cartridge>

Next, an overall configuration of the cartridge A will be described with reference to FIG. 3. FIG. 3 is a cross-sectional view of the cartridge A. In the present exemplary embodiment, description of screws, used for coupling components with each other, is omitted.

As illustrated in FIG. 3, the cartridge A includes the cleaning unit 60 and the developing unit 20. The cleaning unit 60 includes the photosensitive drum 62, the charging roller 66, and the cleaning blade 77, a cleaning frame 71 holding these components, and a lid member 72 fixed to the cleaning frame 71 by welding and the like. In the cleaning unit 60, the charging roller 66 and the cleaning blade 77 are each arranged in contact with the outer circumference surface of the photosensitive drum 62.

The developing unit 20 includes the development roller 32, a development container 23 which supports the development roller 32, the development blade 42, and the like. A magnet roller 34 is incorporated in the development roller 32. The development container 23 includes a lid member 22 as a part of the development container 23 fixed by welding and the like. The development blade 42 that regulates the toner layer on the development roller 32 is disposed in the developing unit 20. The cleaning unit 60 and the developing unit 20 are coupled to each other with a coupling pin (not illustrated) to be rotatable with respect to each other, to form the cartridge A.

<Cartridge Attaching/Detaching>

Figure 4A:
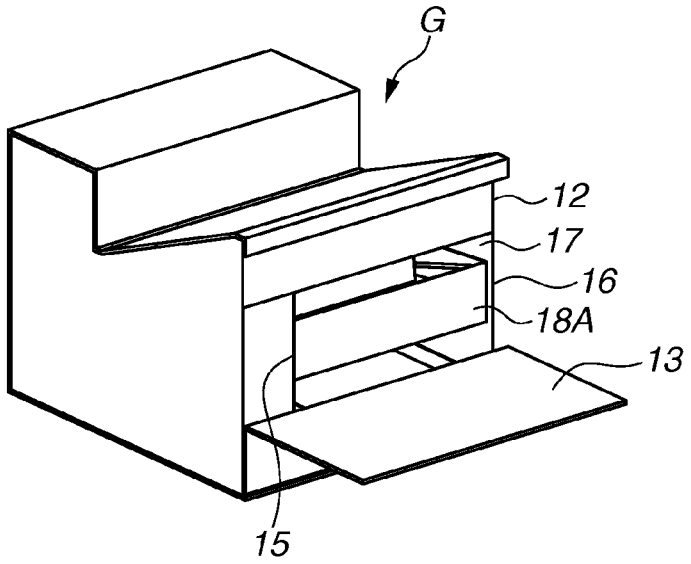
FIGS. 4A, 4B, and 4C are each a perspective view of the image forming apparatus main body according to the first exemplary embodiment.
Figure 4B:
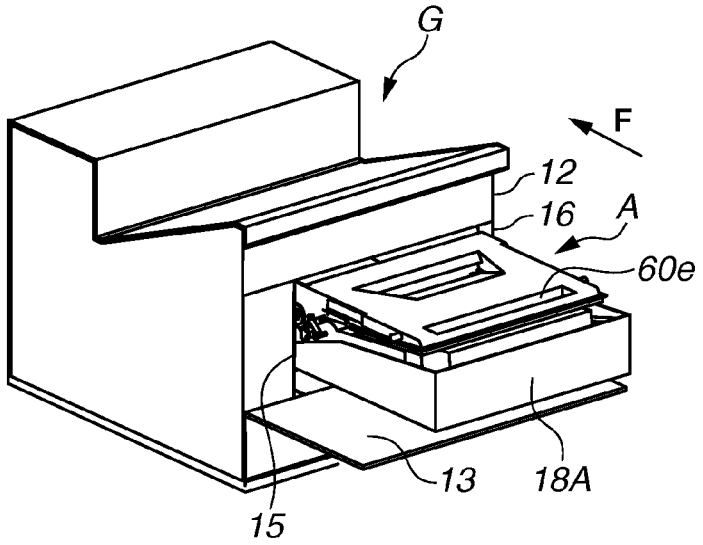
Figure 4C:
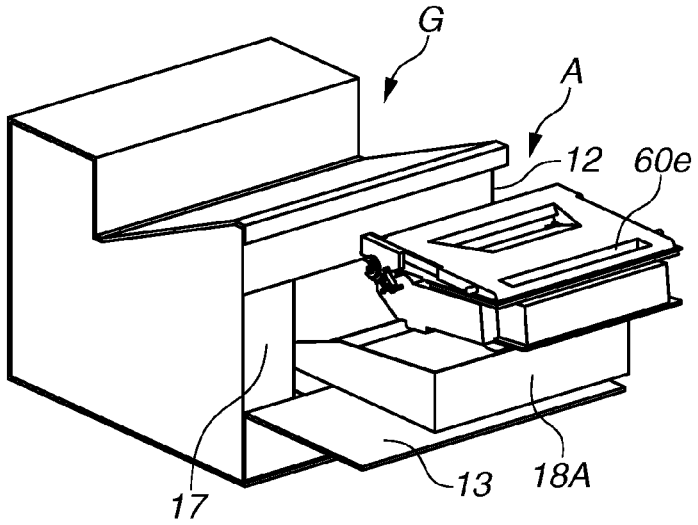

Next, how the cartridge A is attached to/detached from the apparatus main body G will be described with reference to FIGS. 4A, 4B, and 4C. FIG. 4A is a perspective view of the apparatus main body G when an opening/closing door 13, for attaching or detaching the cartridge A, is open. FIG. 4B is a perspective view of the apparatus main body G in a state where the opening/closing door 13 for attaching or detaching the cartridge A, is open, and a cartridge tray 18A on which the cartridge A is placed is pulled out. FIG. 4C is a perspective view of the apparatus main body G in a state where the cartridge A is taken out from the cartridge tray 18A.

As illustrated in FIGS. 4A, 4B, and 4C, the opening/closing door 13 is rotatably attached to the frame 12 forming the apparatus main body G. An opening 17 appears when the opening/closing door 13 is open. The cartridge tray 18A with which the cartridge A is attached to the apparatus main body G is disposed in the opening 17. When the cartridge tray 18A on which the cartridge A is placed moves along a guiderail (not illustrated) in a direction indicated by an arrow F in FIG. 4B, the cartridge A is attached to an attachment position in the apparatus main body G. On the other hand, the cartridge A can be taken out from the apparatus main body G in the state where the cartridge tray 18A is pulled out from the apparatus main body G.

In a configuration according to the present exemplary embodiment, the cartridge A compatible with a particular image forming apparatus can be installed in the apparatus main body G, and an incompatible cartridge can be prevented from being erroneously inserted, and thus the erroneous insertion can be prevented. A configuration of the cartridge A according to the present exemplary embodiment and a configuration of the apparatus main body G are described below in detail. In addition, an operation of attaching and detaching the cartridge A to and from the apparatus main body G which enables prevention of the erroneous insertion is described.

Figure 5:
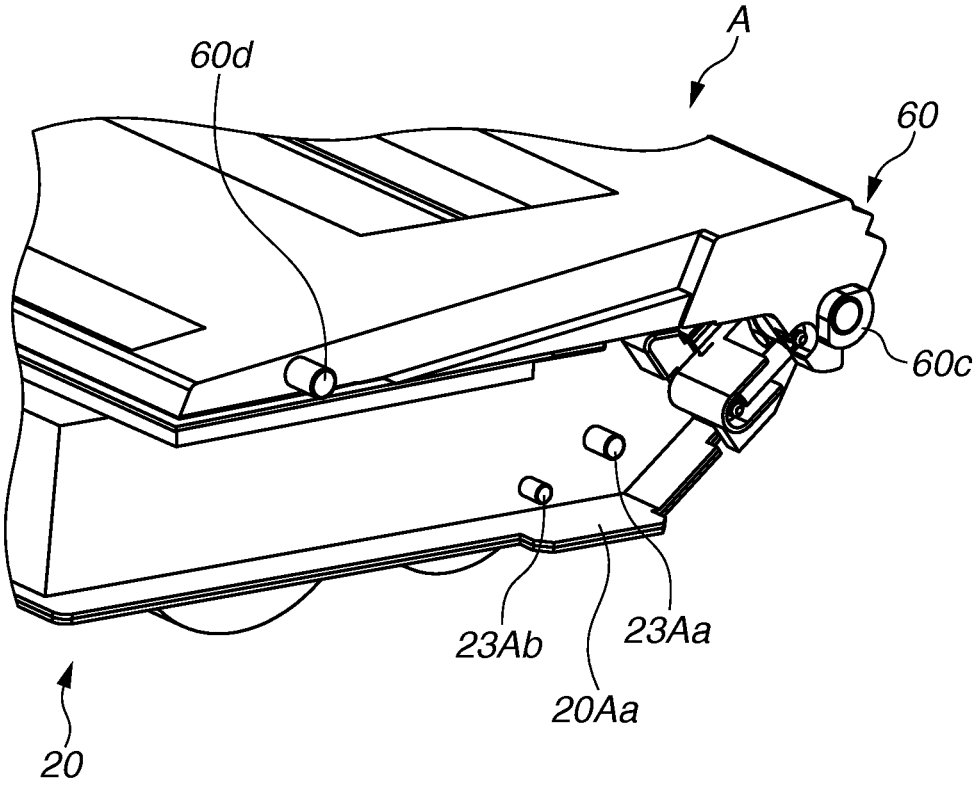
FIG. 5 is a perspective view of an end surface on a non-driving side of the cartridge and the image forming apparatus main body according to the first exemplary embodiment.
Figure 6:
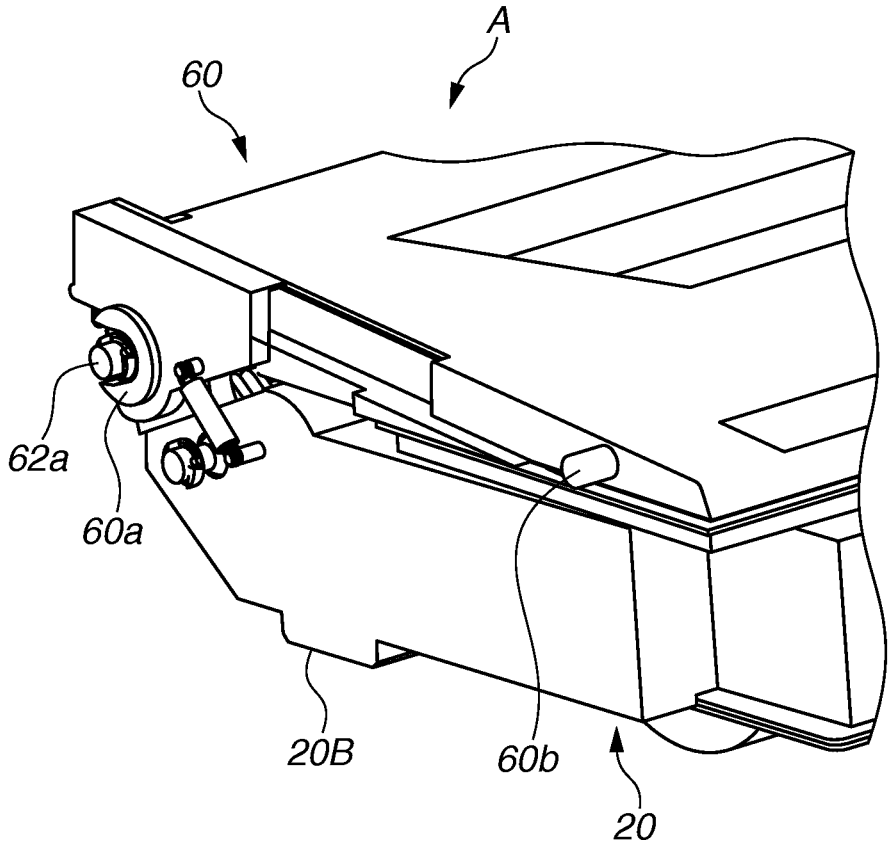
FIG. 6 is a perspective view of an end surface on a driving side of the cartridge and the image forming apparatus main body according to the first exemplary embodiment.

First, a configuration of the cartridge A is described with reference to FIGS. 5 and 6. FIGS. 5 and 6 are each a diagram illustrating an end surface intersecting with an insertion direction of the cartridge A. As illustrated in FIG. 5, on one end surface of the cartridge A, a supported portion 60*c*, a first boss 23Aa, a second boss 23Ab, and a rotated supported portion 60*d* are arranged in this order from an upstream side in an insertion direction E of the cartridge A (hereinafter, referred to as an upstream side). The developing unit 20 includes a protruding portion 20Aa protruding in the one end surface to one end side of the tray 18A. The second boss 23Ab and the first boss 23Aa are arranged in this order from the protruding portion 20Aa in a direction orthogonal to the insertion direction E. As illustrated in FIG. 6, the cartridge A includes, on the other end side, a supported portion 60*a* disposed adjacent to a driving force receiving portion 62*a* and a rotated supported portion 60*b*. The driving force receiving portion 62*a* transmits driving force to the photosensitive drum 62 The supported portion 60*a* and the driving force receiving portion 62*a* are arranged in this order from the upstream side of the cartridge A. The developing unit 20 includes, on the other end side, a bottom portion 20B on the side having the protruding portion 20Aa in the direction orthogonal to the insertion direction E. At a portion around the other end side, the bottom portion 20B protrudes downward. As described above, in the present exemplary embodiment, the one end side serves as a non-driving side, and the other end side serves as a driving side. The first boss 23Aa and the second boss 23Ab are disposed on the non-driving side. The cleaning unit 60 has the supported portions 60*a* and 60*c* and the rotated supported portions 60*b* and 60*d*.

Figure 1:
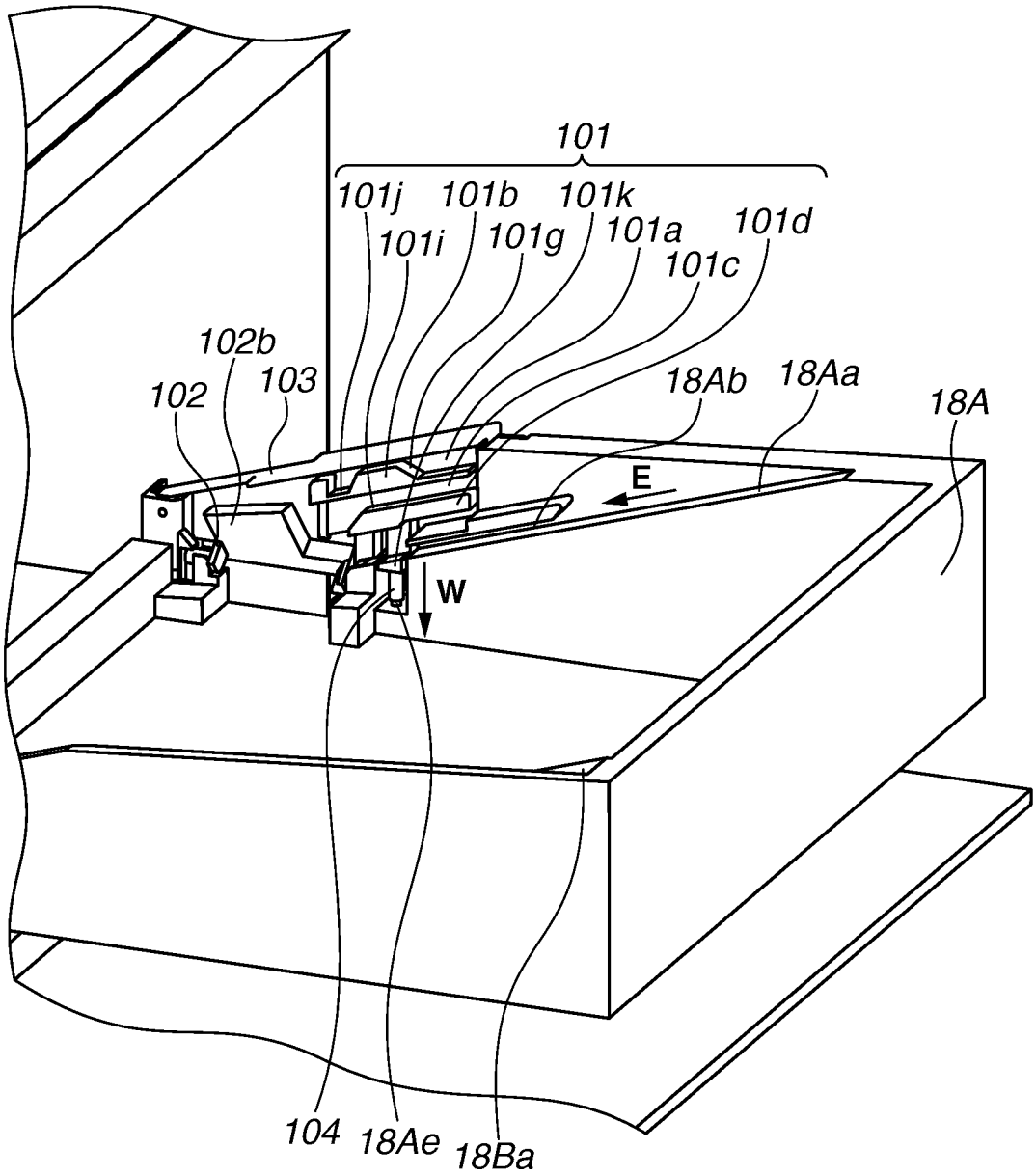
FIG. 1 is a perspective view of a movable member provided in a tray according to a first exemplary embodiment.
Figure 7A:
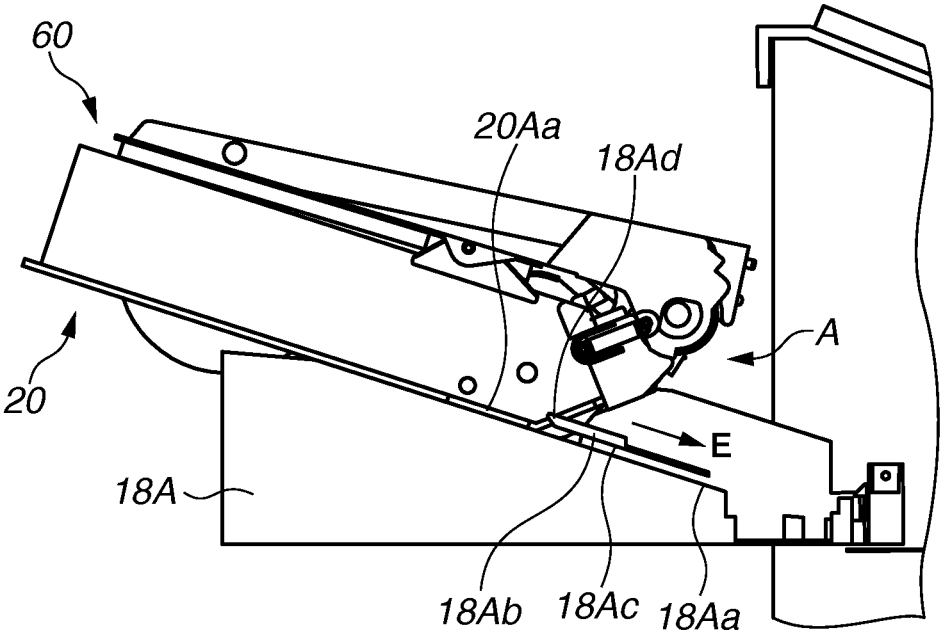
FIGS. 7A and 7B are each a side view illustrating attaching of the cartridge to the tray according to the first exemplary embodiment.
Figure 7B:
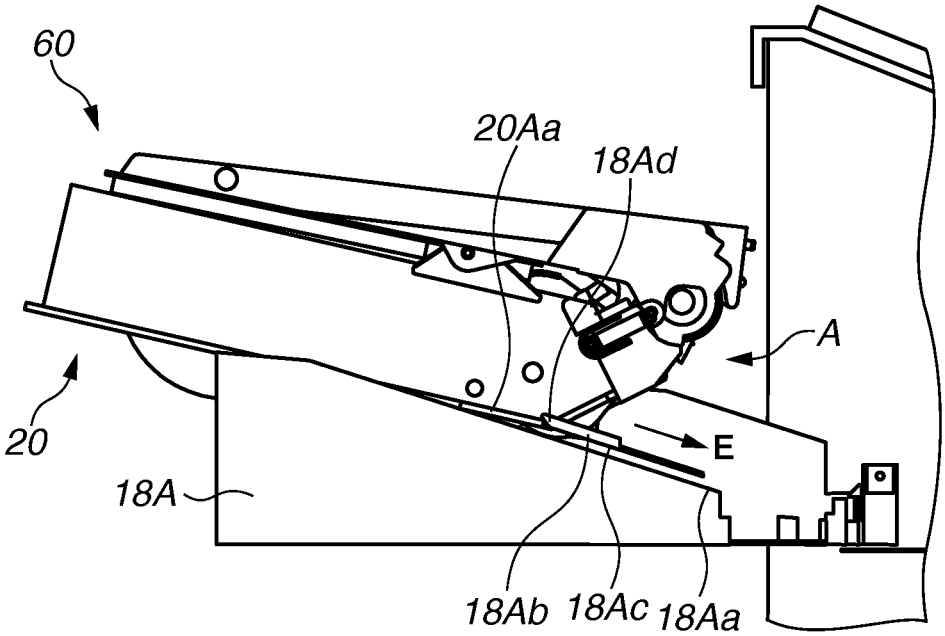

Next, a configuration related to the apparatus main body G is described with reference to FIGS. 1, 7A, and 7B. FIG. 1 is a perspective view illustrating a movable member 101 disposed on the tray 18A. FIGS. 7A and 7B are each a side view of one end side, that is, the non-driving side illustrating how the cartridge A is attached to the tray 18A. As illustrated in FIG. 1, the tray 18A has inclined surfaces 18Aa and 18Ba as cartridge attached portions respectively on both ends in the longitudinal direction. The inclined surface 18Aa on the one end side can support the protruding portion 20Aa of the cartridge A, and an inclined surface 18Ba on the other end surface side can support the bottom portion 20B of the cartridge A.

As illustrated in FIG. 7A, on the one end side, a guide portion 18Ab is disposed above the inclined surface 18Aa along the inclined surface 18Aa, on the upstream side of the cartridge A. A guide surface 18Ac facing the inclined surface 18Aa is disposed on the lower side of the guide portion 18Ab. An auxiliary surface 18Ad is formed on the upstream side of the guide surface 18Ac. In the present exemplary embodiment, the auxiliary surface 18Ad is sharply inclined with respect to the insertion direction E.

The inclined surface 18Aa and the guide portion 18Ab each have a shape extending along the insertion direction E of the cartridge A to guide the cartridge A. Thus, the cartridge A has the protruding portion 20Aa which is movable along the inclined surface 18Aa and the guide portion 18Ab, so as to be attachable and detachable.

As illustrated in FIG. 1, the tray 18A has, on one end side, the movable member 101, a rotating member 102, a cover 103, and an urging spring 104 that urges the movable member 101 and the rotating member 102, on a downstream side of the guide portion 18Ab in the insertion direction E (hereinafter, referred to as a downstream side). In the present exemplary embodiment, the cover 103 presses and stops the movable member 101 which is urged by the urging spring 104, so that the movable member 101 is held at a first position X.

As illustrated in FIG. 1, the movable member 101 has a first engaging portion 101*b* and a second engaging portion 101*d* arranged in this order from the upper side. Thus, the cover 103 provided above the movable member 101 and the first engaging portion 101*b* form a first guide portion 101*a*. The first boss 23Aa of the cartridge A can enter the first guide portion 101*a* when the movable member 101 moves.

Figure 8:
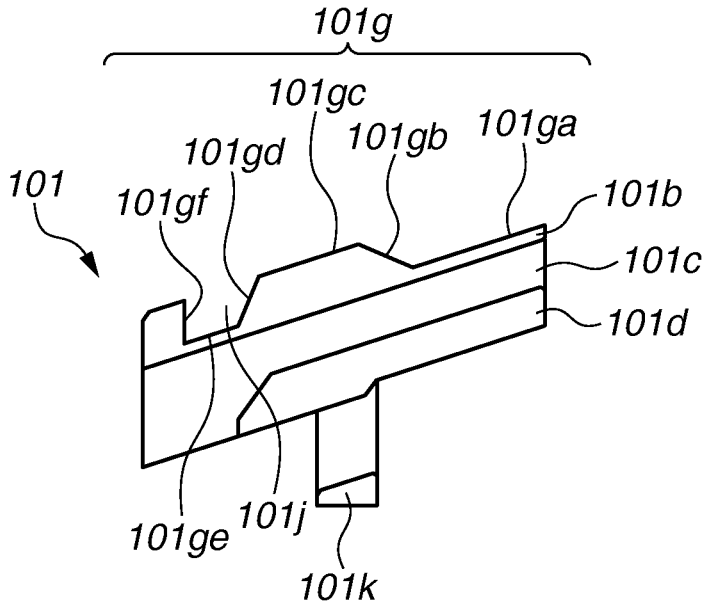
FIG. 8 is a schematic view of a movable member provided in the tray according to the first exemplary embodiment.

More specifically, as illustrated in FIG. 8, an upper surface portion 101*g* is provided on an upper side of the first engaging portion 101*b*. The upper surface portion 101*g* includes a first supporting surface 101*ga*, a first inclined surface 101*gb*, a second supporting surface 101*gc*, a second inclined surface 101*gd*, a third surface 101*ge*, and a regulating surface 101*gf* arranged in this order from the upstream side. The first supporting surface 101*ga* forms the first guide portion 101*a* with the cover 103, at the first position X where the movable member 101 receives no force from the first and the second bosses 23Aa and 23Ab and is urged by the urging spring 104 such that the first boss 23Aa can enter the first guide portion 101*a*. While the first supporting surface 101*ga* is provided in the present exemplary embodiment, the first supporting surface 101*ga* may not be provided. The first inclined surface 101*gb* has an inclined surface having such a shape that the first guide portion 101*a* defined by the first inclined surface 101*gb* and the cover 103, on the downstream side of the first supporting surface 101*ga*, has a smaller width in a vertical direction as it comes closer to the downstream end. The second supporting surface 101*gc*, on the downstream side of the first inclined surface 101*gb*, has substantially the same inclination angle as the inclined surface 18Aa. The second inclined surface 101*gd* has an inclined surface having such a shape that the first guide portion 101*a* defined by the second inclined surface 101*gd* and the cover 103, on the downstream side of the second supporting surface 101*gc*, has a larger width in a vertical direction as it comes closer to the downstream end. Lastly, the regulating surface 101*gf* extends in the urging direction of the urging spring 104 on the downstream side of the second inclined surface 101*gd*. Further, the second inclined surface 101*gd* and the regulating surface 101*gf* constitutes a first recess portion 101*j*. In the present exemplary embodiment, the third surface 101*ge* having substantially the same inclination angle as the inclined surface 18Aa, is disposed between the second inclined surface 101*gd* and the regulating surface 101*gf*. Alternatively, the third surface 101*ge* may not be provided.

As illustrated in FIG. 1, the first engaging portion 101*b* and the second engaging portion 101*d* form a second guide portion 101*c*. The second engaging portion 101*d* is formed in such a manner that the second boss 23Ab of the cartridge A can enter the second engaging portion 101*d* when the movable member 101 moves. In the present exemplary embodiment, a second flat surface 101*i* having substantially the same inclination angle as the inclined surface 18Aa is formed on the upper side of the second engaging portion 101*d*. A lower part on an upstream side of the second engaging portion 101*d* overlaps an upper part on a downstream side of the guide portion 18Ab so that a continuous structure is formed in which the cartridge A can be more stably inserted. An urged portion 101*k* is disposed in a lower portion of the movable member 101. The urging spring 104 is disposed in the tray 18A in such a manner as to push the urged portion 101*k* upward. The urging spring 104 is fixed to a fixing boss 18Ae of the tray 18A.

Figure 9A:
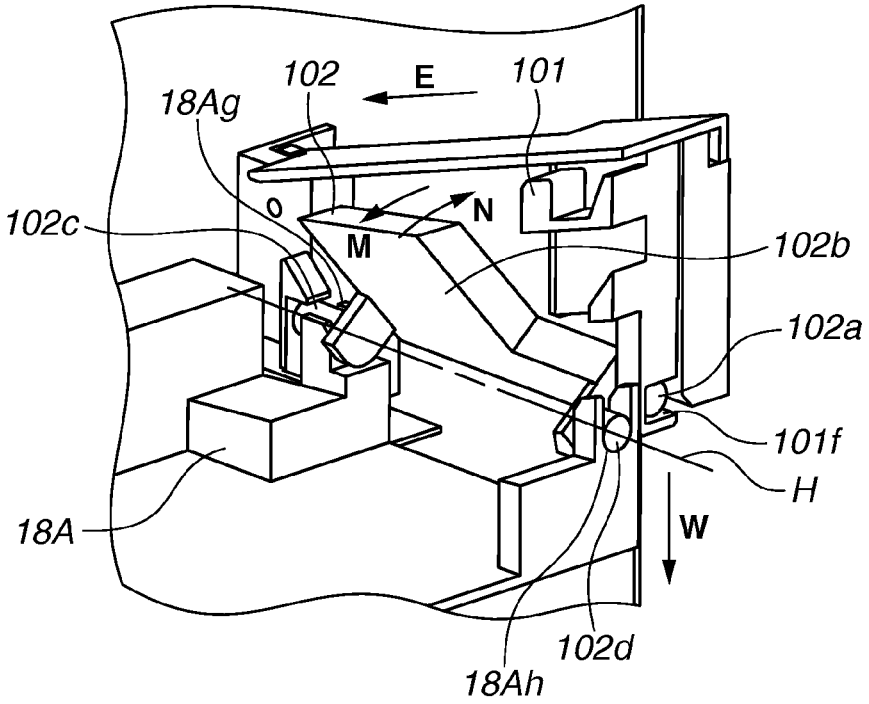
FIGS. 9A and 9B are each a perspective view of an erroneous attachment prevention mechanism according to the first exemplary embodiment.
Figure 9B:
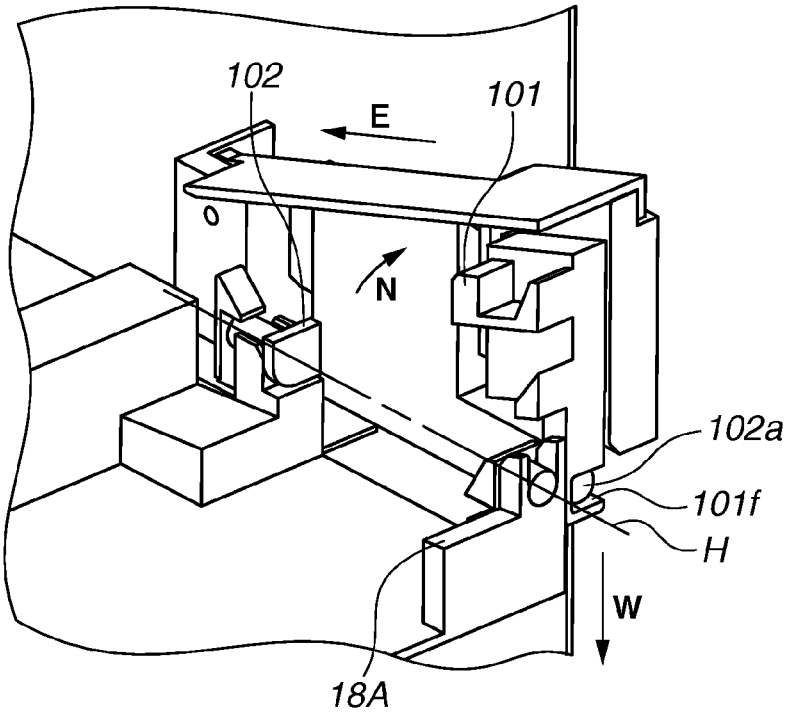

Furthermore, according to the present exemplary embodiment, an erroneous attachment prevention mechanism uses the rotating member 102. A configuration of the rotating member 102 is described with reference to FIGS. 9A and 9B. FIG. 9A is a perspective view of a part of the movable member 101 and the rotating member 102 in a state where the movable member 101 is at the first position X. FIG. 9B is a perspective view of the part of the movable member 101 and the rotating member 102 in a state where the movable member 101 is at a second position Y with the cartridge A inserted to the tray 18A.

The rotating member 102 includes an engaging boss 102*a*, shaft portions 102*c* and 102*d*, and a pivoting surface 102*b*. The shaft portions 102*c* and 102*d* are each disposed on both ends of the pivoting surface 102*b*. The shaft portions 102*c* and 102*d* are supported by the tray 18A, and the rotating member 102 is rotatable about a rotational center (rotational axis) H connecting the shaft portions 102*c* and 102*d*. As described above, the rotating member 102 is formed to have the rotational center (rotational axis) H intersecting with the insertion direction E. The engaging boss 102*a* is disposed at a position separated from the rotational center H connecting the shaft portions 102*c* and 102*d* of the rotating member 102, by a predetermined distance. The engaging boss 102*a* engages with an engaging portion 101*f* disposed in the movable member 101, and one of the movable member 101 and the rotating member 102 can operate in conjunction with each other.

As illustrated in FIG. 9A, the rotating member 102 has the shaft portions 102*c* and 102*d* respectively engaged with grooves 18Ag and 18Ah in the tray 18A, and thus the movable member 101 pivots about the rotational center H. The engaging boss 102*a* engages with the engaging portion 101*f* to be rotatable in the engaging portion 101*f*, so that one of the movable member 101 and the rotating member 102 operates in conjunction with each other. When the cartridge A is not inserted to the tray 18A, that is, when the movable member 101 is at the first position X, the pivoting surface 102*b* of the rotating member 102 protrudes beyond the movable member 101 toward the driving side. Thus, the pivoting surface 102*b* blocks insert positions of the first boss 23Aa and the second boss 23Ab, and the rotating member 102 protrudes to a portion abutting on the cartridge A in the insertion direction E and thus interfering with the cartridge A.

As illustrated in FIG. 9B, when the cartridge A is inserted to the tray 18A, the movable member 102 moves in a downward direction W (FIG. 1) as described above. As a result, the engaging boss 102*a* of the rotating member 102 receives force in the downward direction W from the engaging portion 101*f* of the movable member 101, so that the rotating member 102 pivots in a direction indicated by an arrow N to be retracted to a retract position so as not to abut pm the cartridge A in the insertion direction E. That is, when the rotating member 102 is retracted, the cartridge A can be attached to the tray 18A.

When the cartridge A is pulled out from the tray 18A, the movable member 101 moves in an upward direction, and thus the engaging boss 102*a* of the rotating member 102 receives force in the upward direction from the engaging portion 101*f* of the movable member 101. As a result, the rotating member 102 pivots about the rotational center in a direction indicated by an arrow M, and thus returns to the position abutting on the cartridge A and thus interfering with the cartridge A in the insertion direction E as illustrated in FIG. 9A.

<Operation of Attaching Cartridge A to Tray 18A>

As illustrated in FIG. 4, the opening 17 appears when the opening/closing door 13 of the apparatus main body G is opened. The tray 18A is taken out from the apparatus main body G by holding a tray handle portion (not illustrated) formed on a front side of the tray 18A and pulling the handle in a direction opposite to a direction indicated by an arrow F. At this time, by a pull out amount regulating member (not illustrated) provided in the tray 18A and the opening/closing door 13, the tray 18A protrudes from the opening 17 of the apparatus main body G by a predetermined amount. When the tray 18A is in the protruding state, the cartridge A can be attached or detached. More specifically, the cartridge A to be attached to the tray 18A can be attached by holding a cartridge handle portion 60*e* provided in the cartridge A, and by inserting the cartridge A toward the upstream side. The cartridge A can also be pulled toward the downstream side to be taken out.

In the attached state, on the driving side, the supported portion 60*a* is supported by a supporting portion (not illustrated) provided in a driving side plate 15 of the apparatus main body G. On the non-driving side, the supported portion 60*c* is supported by a supporting portion (not illustrated) provided in a non-driving side plate 16 of the apparatus main body G. With this structure, the cartridge A is positioned relative to the apparatus main body G and is fixed. The cartridge A has, on the driving side, the rotated supported portion 60*b* supported by a rotational supporting portion (not illustrated) provided in the driving side plate 15 of the apparatus main body G, and has, on the non-driving side, the rotated supported portion 60*d* supported by a rotational supporting portion (not illustrated) provided in the non-driving side plate 16 of the apparatus main body G. With this structure, the cartridge A is prevented from rotating relative to the apparatus main body G. When the opening/closing door 13 is closed in the state where the cartridge A is positioned relative to the apparatus main body G and is fixed, the image forming apparatus can perform an image forming operation. On the other hand, when the opening/closing door 13 is opened and the tray 18A is pulled in the direction opposite to the direction indicated by the arrow F, the positioning, fixing, and rotation prevention of the cartridge A with respect to the apparatus main body G are released, so that the cartridge A can be detached from the apparatus main body G.

<Case of Compatible Cartridge A>

Next, an operation of attaching and detaching the cartridge A to and from the tray 18A is described with reference to FIGS. 7A, 7B, and FIGS. 10 to 12A, 12B, and 12C.

Figure 10:
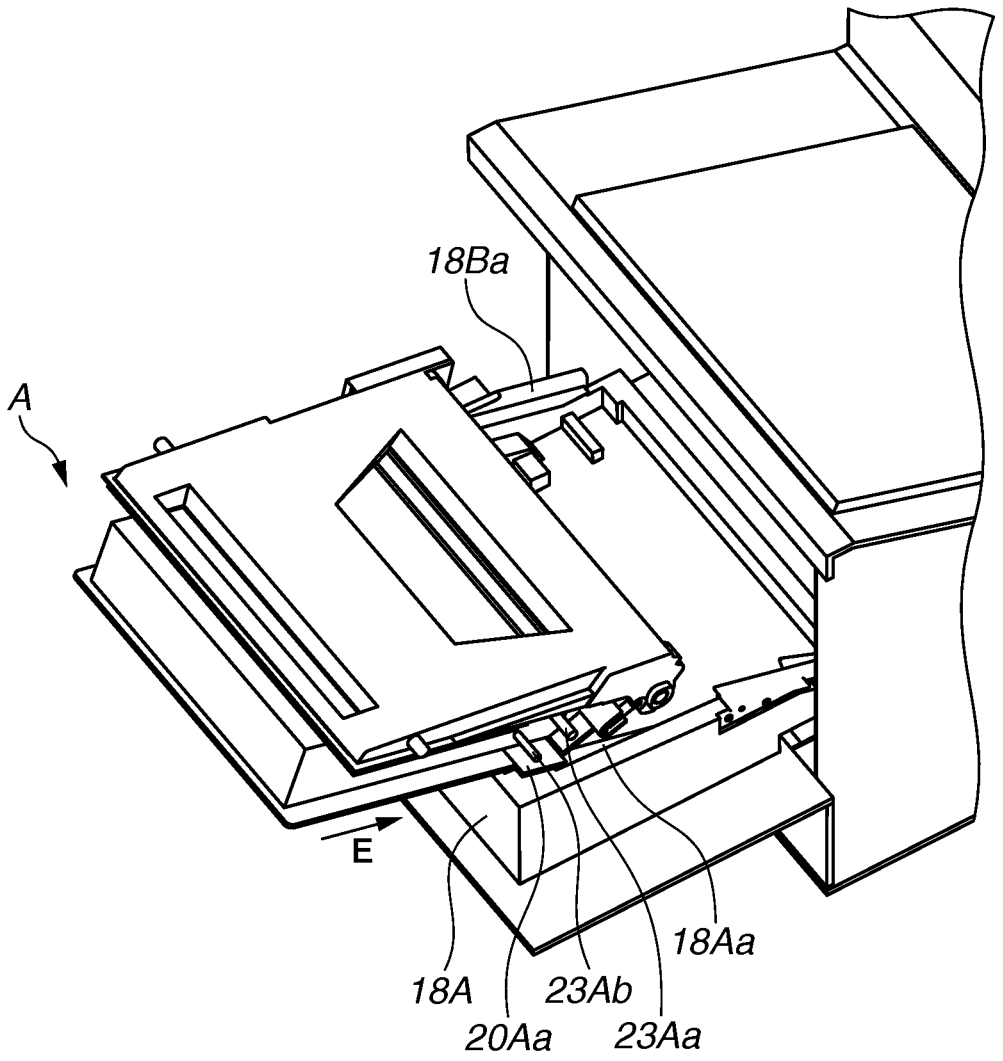
FIG. 10 is a perspective view of the cartridge according to the first exemplary embodiment.

First, as illustrated in FIGS. 10 and 7A, the protruding portion 20Aa of the cartridge A is placed on the upstream side of the inclined surface 18Aa of the tray 18A. On the other end, the bottom portion 20B of the cartridge A is placed on the upstream side of the inclined surface 18Ba.

When the cartridge A moves toward the downstream side, as illustrated in FIG. 7B, the protruding portion 20Aa is guided by the auxiliary surface 18Ad disposed on the upstream side of the guide portion 18Ab of the tray 18A, into a gap between the guide portion 18Ab and the inclined surface 18Aa. Then, the protruding portion 20Aa of the cartridge A can pass through a gap between the inclined surface 18Aa of the tray 18A and the guide surface 18Ac of the guide portion 18Ab. That is, the movement of the cartridge A in a direction orthogonal to the inclined surface 18Aa of the tray 18A is restricted and thus, the position of the cartridge A becomes stable.

Figure 11A:
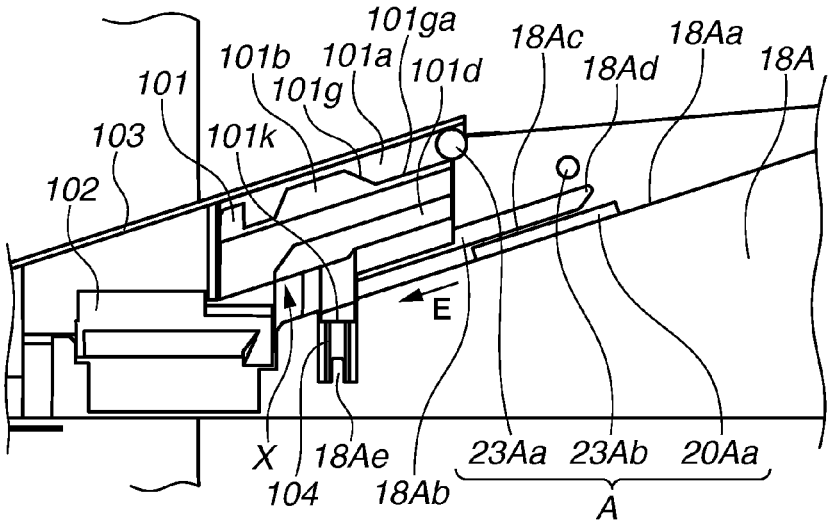
FIGS. 11A, 11B, and 11C are each a schematic view illustrating an operation of the movable member provided in the tray according to the first exemplary embodiment.

When the cartridge A further moves toward the downstream side, as illustrated in FIG. 11A, the first boss 23Aa of the cartridge A enters the first guide portion 101*a*. Thus, the protruding portion 20Aa engages with the guide portion 18Ab, and the first boss 23Aa engages with the cover 103. Consequently, an upward movement of the cartridge A is restricted. FIG. 11A is a schematic view of the non-driving side of the movable member 101 at the first position X.

Figure 11B:
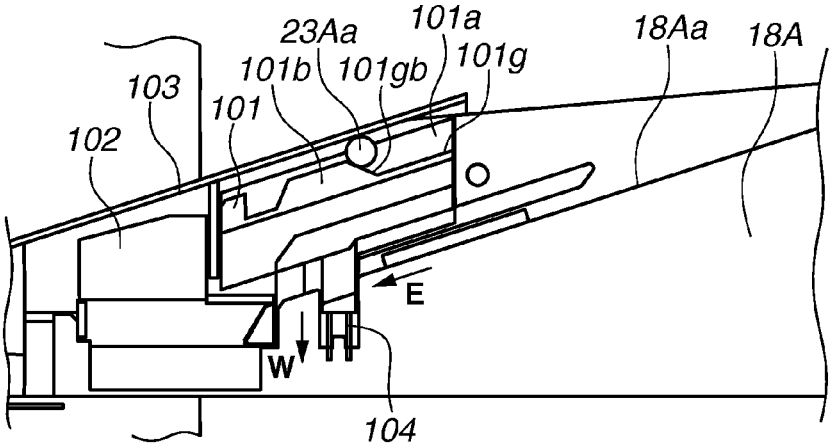

As illustrated in FIG. 11B, when the first boss 23Aa of the cartridge A enters the first guide portion 101*a*, the first boss 23Aa comes into contact with the first engaging portion 101*b*. Thus, the upper surface portion 101*g* of the first engaging portion 101*b* receives the force in the downward direction W from the first boss 23Aa, so that the movable member 101 moves in the downward direction W. More specifically, after the first boss 23Aa passes through the gap between the first supporting surface 101*ga* and the cover 103 (FIG. 11A), the first boss 23Aa enters a gap between the first inclined surface 101*gb* and the cover 103 (FIG. 11B). As a result, the first boss 23Aa comes into contact with the first inclined surface 101*gb*, and the movable member 101 moves in the downward direction W against the upward urging force of the urging spring 104.

Figure 11C:
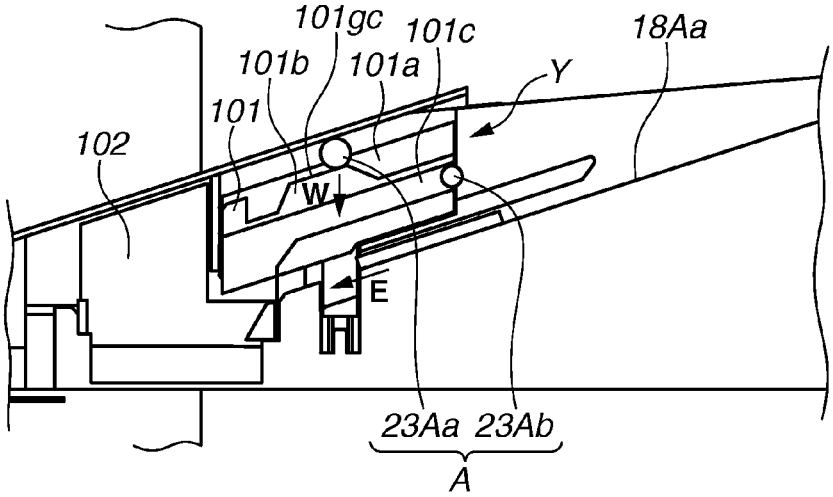

As illustrated in FIG. 11C, when the cartridge A further moves toward the downstream side, the first boss 23Aa reaches the second supporting surface 101*gc* of the first guide portion 101*a*. At this time, the first boss 23Aa comes into contact with the second supporting surface 101*gc*, so that the movable member 101 receives the force in the downward direction W from the first boss 23Aa to move in the downward direction W by a predetermined distance and is held at the incoming position. More specifically, in the present exemplary embodiment, since the second supporting surface 101*gc* is in parallel with the inclined surface 18Aa, the movable member 101 is held at the second position Y to which the movable member 101 has moved in the downward direction W by the predetermined distance. Consequently, the second boss 23Ab can enter the second guide portion 101*c* when the cartridge A moves toward the downstream side. Thus, when the cartridge A further moves toward the downstream side, the second boss 23Ab of the cartridge A enters the second guide portion 101*c* of the movable member 101.

Figure 12A:
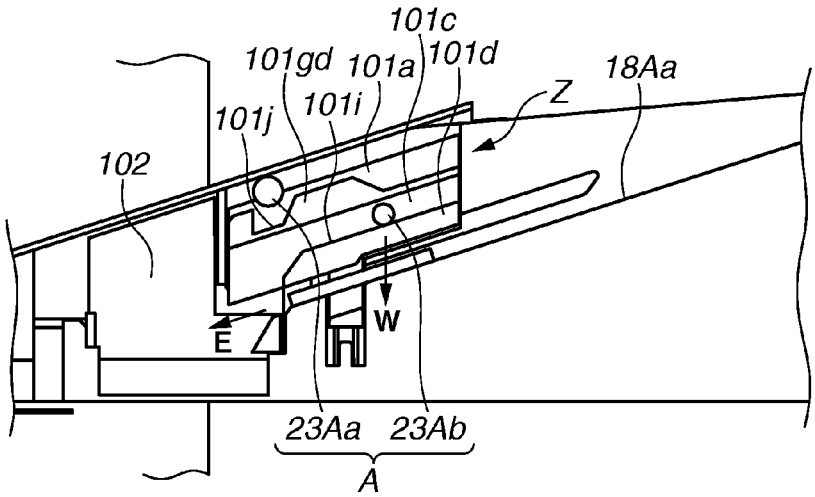
FIGS. 12A, 12B, and 12C are each a schematic view illustrating an operation of the movable member provided in the tray according to the first exemplary embodiment.
Figure 12B:
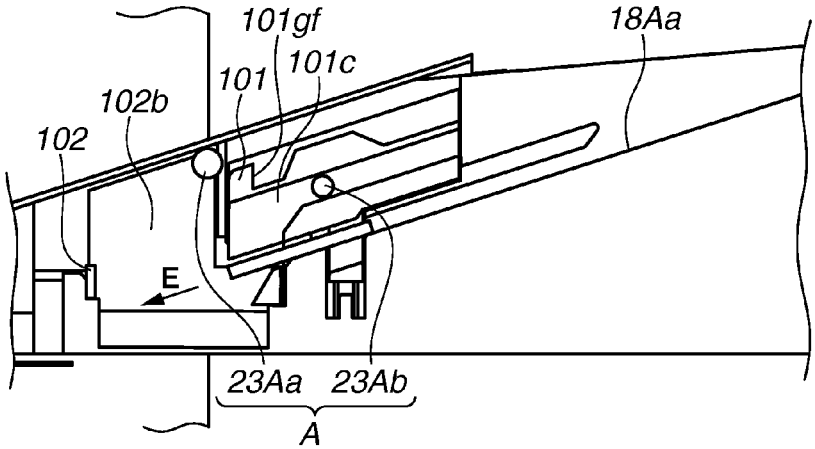

As illustrated in FIG. 12A, when the cartridge A further moves toward the downstream side, the first boss 23Aa reaches the first recess portion 101*j* of the first guide portion 101*a*. The first boss 23Aa moves along the second inclined surface 101*gd*, and thus the movable member 101 moves toward the downward direction W by a predetermined distance. Accordingly, the second flat surface portion 101*i* of the second engaging portion 101*d* comes into contact with the second boss 23Ab of the cartridge A. As a result, the first boss 23Aa is separated from the second inclined surface 101*gd*, so that the movable member 101 receives the force in the downward direction W from the second boss 23Ab to move toward the downward direction W by a predetermined distance and is held at the incoming position. More specifically, in the present exemplary embodiment, since the second flat surface portion 101*i* is in parallel with the inclined surface 18Aa, the movable member 101 is held at a third position Z as a result of moving toward the downward direction W by the predetermined distance. The cartridge A further moves toward the downstream side in the state where the movable member 101 is supported by the second boss 23Ab. As a result, the first boss 23Aa passes through the first guide portion 101*a* without being caught by the regulating surface 101*gf*, and reaches a position where the first boss 23Aa overlaps the regulating portion 102*b* in the direction intersecting with the insertion direction E, as illustrated in FIG. 12B.

Figure 12C:
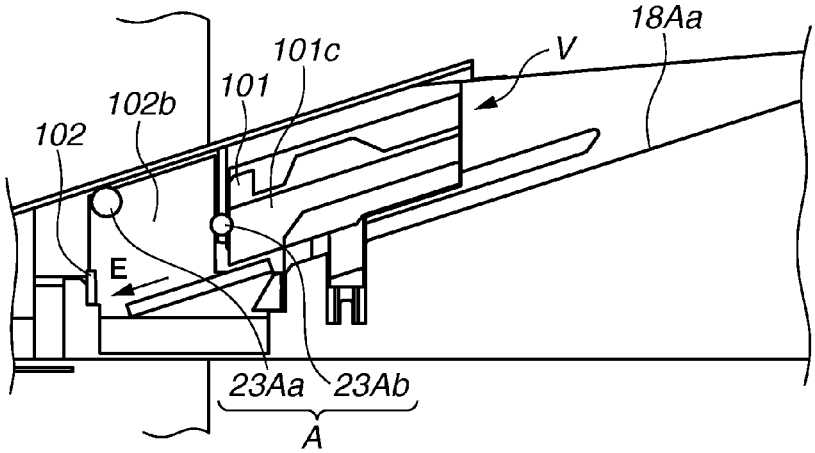

As illustrated in FIG. 12C, when the cartridge A further moves toward the downstream side, the second boss 23Ab is separated from the second guide portion 101*c*. At this time, the first boss 23Aa and the second boss 23Ab do not hold the movable member 101 by directly contacting the movable member 101. Instead, the regulating portion 102*b* of the rotating member 102 contacts the first boss 23Aa of the cartridge A in the longitudinal direction, so that the regulating portion 102*b* is prevented from pivoting in the direction indicated by the arrow M in FIG. 9A by the first boss 23Aa. As a result, the rotating member 102 supports the movable member 101 coupled thereto in such a manner that the movable member 101 is held at a fourth position V against the urging force of the urging spring 104.

When the cartridge A is fully inserted toward the downstream side in the insertion direction E, the attaching of the compatible cartridge A to the tray 18A is completed. In this manner, the compatible cartridge A can be inserted to the tray 18A. Additionally, in such a state, with respect to the movable member 101, at least one of the first boss 23Aa and the second boss 23Ab is in contact with the regulating portion 102*b* of the rotating member 102 in the longitudinal direction of the cartridge A, so that the regulating portion 102*b* is prevented from pivoting in the direction indicated by the arrow M in FIG. 9A.

The movable member 101 receives the force in the downward direction W from the second boss 23Ab when pulled toward the upstream side of the cartridge A, so that the first boss 23Aa can enter the movable member 101. Thus, the cartridge A attached to the tray 18A can be taken out.

<Case of Incompatible Cartridge B>

Figure 13A:
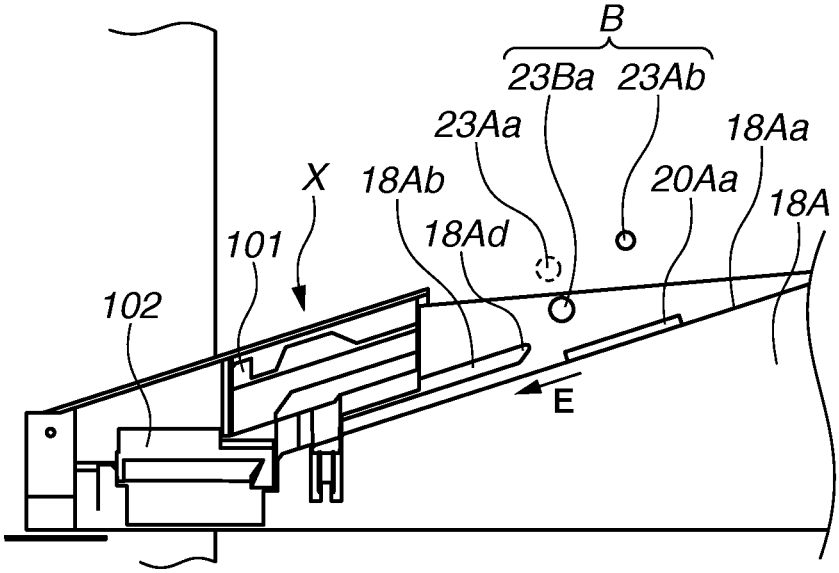
FIGS. 13A and 13B are each a diagram illustrating a case where an incompatible cartridge is inserted, according to the first exemplary embodiment.
Figure 13B:
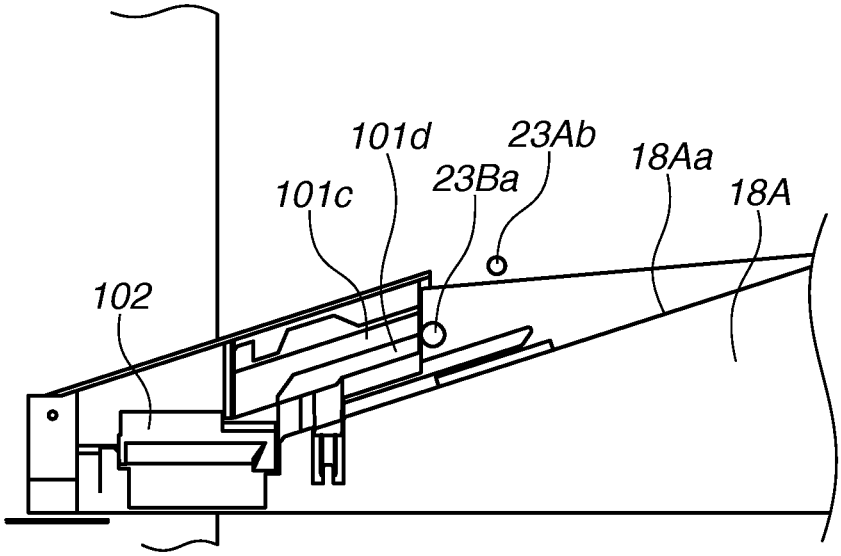

Next, a case where an incompatible cartridge B is inserted to the tray 18A is described with reference to FIGS. 13A and 13B. FIGS. 13A and 13B are each a side view illustrating a state where the incompatible cartridge B is inserted to the tray 18A. As for the cartridge B, points different from the cartridge A are mainly described below, and the configurations similar to those in the cartridge A are denoted with the same reference numerals and will not be described.

The incompatible cartridge B has a first boss 23Ba at a position different from the position where the first boss 23Aa is disposed in the compatible cartridge A. More specifically, as illustrated in FIG. 13A, the position of the first boss 23Ba in the cartridge B is a position shifted in the direction orthogonal to the insertion direction E from the first boss 23Aa (dotted line section) toward the inclined surface 18Aa.

The protruding portion 20Aa of the cartridge B is placed on the upstream side of the inclined surface 18Aa of the tray 18A in the insertion direction E. On the other end, the bottom portion 20B of the cartridge B is placed on the upstream side of the inclined surface 18Ba in the insertion direction E. When the cartridge B moves toward the downstream side, as illustrated in FIG. 13B, the protruding portion 20Aa of the cartridge B is guided by the auxiliary surface 18Ad disposed on the upstream side of the guide portion 18Ab of the tray 18A, into a gap between the guide portion 18Ab and the inclined surface 18A. Then, the protruding portion 20Aa can pass through the gap between the inclined surface 18Aa of the tray 18A and the guide surface 18Ac of the guide portion 18Ab. That is, the movement of the cartridge B in a direction orthogonal to the inclined surface 18Aa of the tray 18A is restricted and thus, the position of the cartridge B becomes stable.

When the cartridge B moves toward the downstream side, as illustrated in FIG. 13B, the first boss 23Ba of the cartridge B does not enter the first guide portion 101*a*, and comes into contact with the second engaging portion 101*d*. As a result, the first boss 23Ba cannot enter the first guide portion 101*a*, so that the cartridge B can be prevented from being inserted to the tray 18A. Thus, when the first boss 23Ba is at the position shifted in the direction orthogonal to the insertion direction E, the first boss 23Ba cannot enter the first guide portion 101*a*. That is, the movable member 101 cannot move from the first position X in a free state, and the second boss 23Ab cannot enter the second guide portion 101*c*. Therefore, the incompatible cartridge B can be prevented from being erroneously inserted to the tray 18A.

The above-described configuration should not be construed in a limiting sense. When the first boss 23Ba is placed at a position shifted toward the cover 103 in the direction orthogonal to the insertion direction E, the first boss 23Ba also comes into contact with the first engaging portion 101*b*. Thus, the first boss 23Ba can be prevented from entering the first guide portion 101*a*.

Thus, when the movable member 101 is provided in the tray 18A to prevent the incompatible cartridge B from being erroneously inserted to the apparatus main body G as described above, a user can check whether a cartridge is incompatible in a state where the tray 18A is pulled out from the apparatus main body G. Furthermore, the first boss can be inserted to the movable member 101 in a state where the position of the protruding portion 20Aa of the cartridge B is regulated by the inclined surface 18Aa of the tray 18A and the guide surface 18Ac of the guide portion 18Ab and the movement of the cartridge B in the upward and the downward directions with respect to the tray 18A is restricted. As a result, the cartridge can be prevented from being inserted at an angle different from the angle of the predetermined insertion direction E. Thus, the incompatible cartridge B can be more effectively prevented from being inserted to the apparatus main body G.

<Case of Incompatible Cartridge C>

Figure 14A:
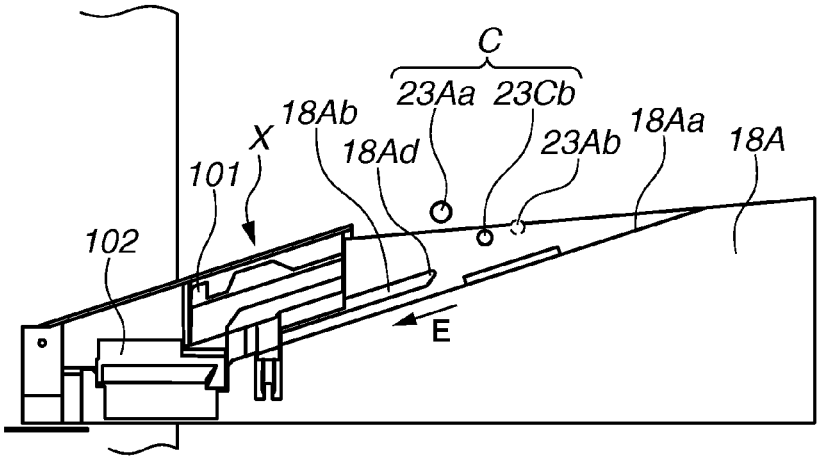
FIGS. 14A, 14B, and 14C are each a diagram illustrating a case where an incompatible cartridge is inserted, according to the first exemplary embodiment.
Figure 14B:
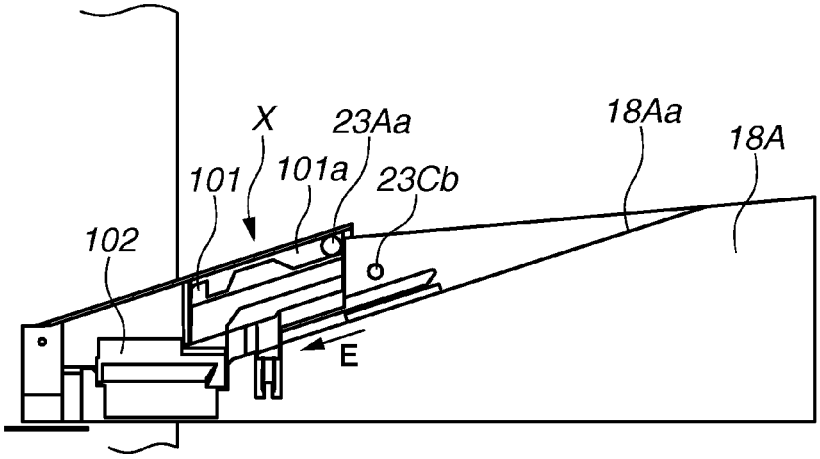
Figure 14C:
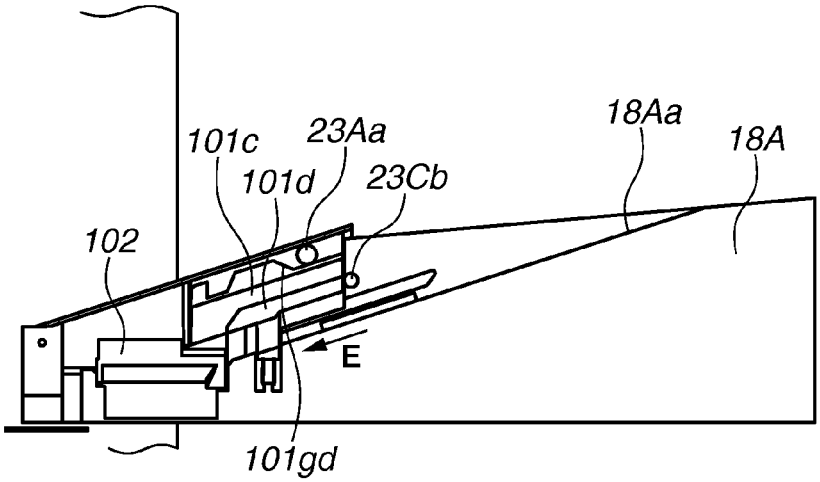

Next, a case where an incompatible cartridge C is inserted to the tray 18A will be described with reference to FIGS. 14A, 14B, and 14C. FIGS. 14A, 14B, and 14C are each a side view illustrating a state where the incompatible cartridge C is inserted to the tray 18A. As for the cartridge C, points different from the cartridge A are mainly described, and the configurations similar to those in the cartridge A are denoted with the same reference numerals and will not be described.

The incompatible cartridge C has a second boss 23Cb at a position different from the position where the second boss 23Ab is disposed in the compatible cartridge A. More specifically, as illustrated in FIG. 14A, the position of the second boss 23Cb in the cartridge C is a position shifted toward the downstream side from the second boss 23Ab (dotted line section).

The protruding portion 20Aa of the cartridge C is placed on the upstream side of the inclined surface 18Aa of the tray 18A. On the other end, the bottom portion 20B of the cartridge C is placed on the upstream side of the inclined surface 18Ba. When the cartridge C moves toward the downstream side, as illustrated in FIG. 14B, the protruding portion 20Aa of the cartridge C is guided by the auxiliary surface 18Ad disposed on the upstream side of the guide portion 18Ab of the tray 18A, into a gap between the guide portion 18Ab and the inclined surface 18Aa. Then, the protruding portion 20Aa of the cartridge C can pass through the gap between the inclined surface 18Aa of the tray 18A and the guide surface 18Ac of the guide portion 18Ab. That is, the movement of the cartridge C in a direction orthogonal to the inclined surface 18Aa of the tray 18A is restricted, and thus, the position of the cartridge C becomes stable.

When the cartridge C further moves toward the downstream side, as illustrated in FIG. 14B, the first boss 23Aa of the cartridge C enters the first guide portion 101*a*. When the cartridge C further moves toward the downstream side, as illustrated in FIG. 14C, the second boss 23Cb comes into contact with the second engaging portion 101*d*. More specifically, the second boss 23Cb attempts to enter the second guide portion 101*c* before the first boss 23Aa pushes the first inclined surface 101*gb* in the downward direction W so that the movable member 101 urged by the urging spring 104 is moved to the second position Y against the urging force of the movable member 101. As a result, the second boss 23Cb cannot enter the second guide portion 101*c*, and the cartridge C can be prevented from entering the tray 18A.

The above-described configuration should not be construed in a limiting sense. When the second boss 23Cb of the cartridge C is placed at a position shifted toward the upstream side from the second boss 23Ab (dotted line section), the second boss 23Cb also comes into contact with the second engaging portion 101*d*. More specifically, the first boss 23Aa moves along the second inclined surface 101*gd*, and the movable member 101 which has been pushed in the downward direction W is moved upward by the urging force of the urging spring 104 to return to the first position X. As a result, the second boss 23Cb cannot enter the second guide portion 101*c*, so that the cartridge C can be prevented from being inserted to the tray 18A.

When the movable member 101 is provided in the tray 18A to prevent the incompatible cartridge C from being erroneously inserted to the apparatus main body G as described above, the user can check whether a cartridge is incompatible in a state where the tray 18A is pulled out from the apparatus main body G. Furthermore, the first boss can be inserted to the movable member 101 in a state where the position of the protruding portion 20Aa of the cartridge C is regulated by the inclined surface 18Aa of the tray 18A and the guide surface 18Ac of the guide portion 18Ab and the movement of the cartridge C in the upward and the downward directions with respect to the tray 18A is restricted. As a result, the cartridge can be prevented from being inserted at an angle different from the angle of the predetermined insertion direction E. Thus, the incompatible cartridge C can be more effectively prevented from being inserted to the apparatus main body G.

<Effects>

According to the first exemplary embodiment, the user can slide the cartridge A, B, or C along the inclined surface 18Aa when attaching the cartridge A, B, or C to the tray 18A. The cartridge A slides down on the inclined surface 18Aa by its own weight. Accordingly, the cartridge A of a heavy weight can be easily inserted to the tray 18A.

As illustrated in FIG. 10, the guide portion 18Ab is provided in the tray 18A, and the protruding portion 20Aa is provided in the cartridge A. Thus, the cartridge A is inserted by sliding along the tray 18A, so that the position of the protruding portion 20Aa is regulated between the inclined surface 18Aa of the tray 18A and the guide surface 18Ac of the guide portion 18Ab. That is, the movement of the cartridge A in the direction orthogonal to the inclined surface 18Aa of the tray 18A is regulated, so that the position of the cartridge A becomes stable. As a result, the cartridge can be prevented from being inserted at an angle different from the angle of the predetermined insertion direction E. Thus, the incompatible cartridge can be more effectively prevented from being inserted to the apparatus main body G. Consequently, the erroneous attaching can be surely prevented regardless of the attaching orientation.

Furthermore, according to the first exemplary embodiment in which the frame 12 includes the tray 18A, by providing the movable member 101 in the tray 18A, the user can check whether the cartridge A, B, or C is incompatible in a state where the tray 18A is pulled out from the apparatus main body G. Thus, the user can visually recognize the contact state outside the apparatus main body G, and can easily determine whether the cartridge is incompatible.

According to the present exemplary embodiment, the protruding portion 20Aa, the first boss 23Aa, and the second boss 23Ab are disposed on the side surface on the non-driving side of the movable member 101 of the tray 18A and the cartridge A. Alternatively, the protruding portion 20Aa, the first boss 23Aa, and the second boss 23Ab may be disposed on the driving side surface or on both sides in the axial direction.

Figure 15:
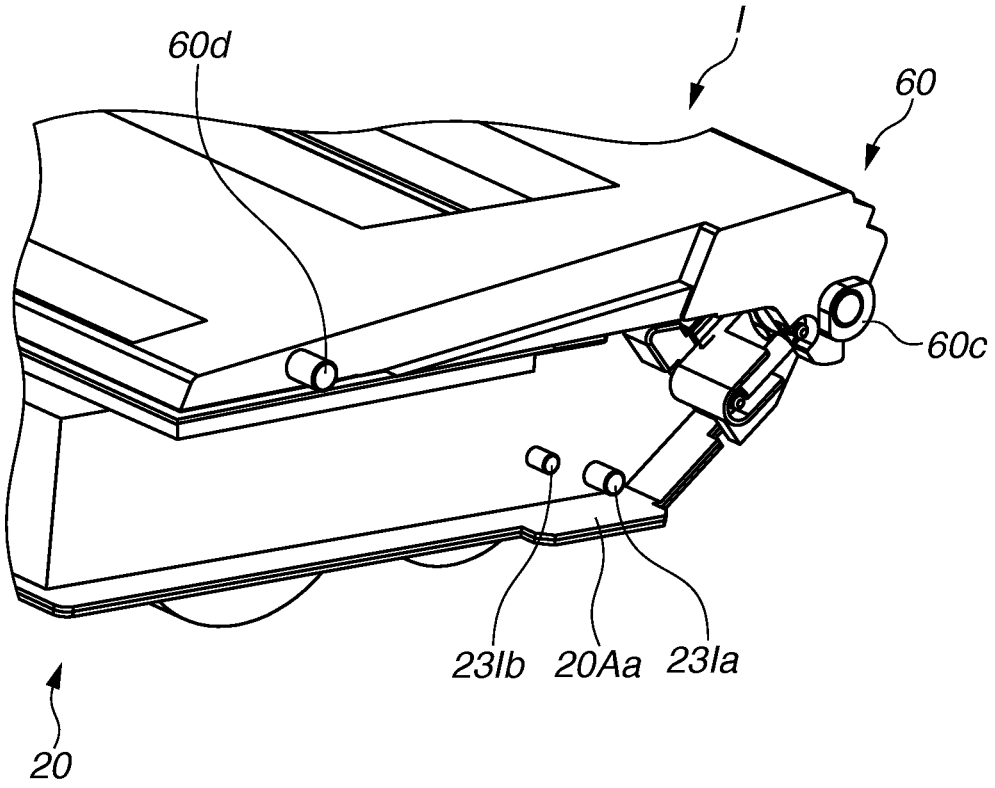
FIG. 15 is a perspective view of an end surface on a non-driving side of a cartridge and an image forming apparatus main body according to a second exemplary embodiment.
Figure 16:
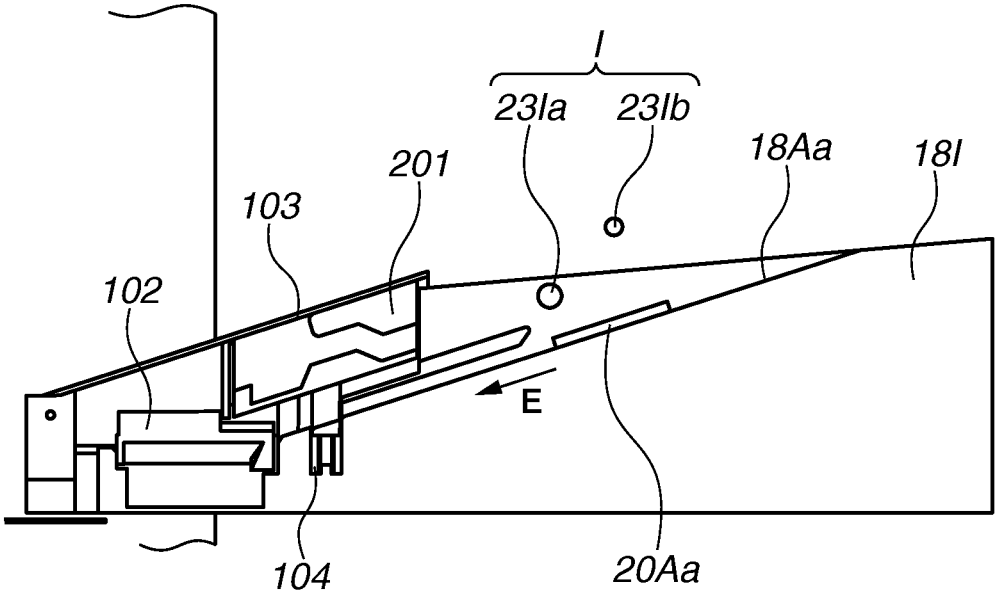
FIG. 16 is a side view illustrating attaching of the cartridge to a tray according to the second exemplary embodiment.

Next, a second exemplary embodiment of the present invention will be described with reference to FIGS. 15 to 17.

According to the present exemplary embodiment, portions different from the exemplary embodiment described above will be described in detail. The materials and the shapes are the similar to those in the exemplary embodiment described above unless otherwise specified. These common portions are denoted with the same reference numerals and will not be described in detail.

A configuration related to a cartridge I will be described in detail with reference to FIG. 15. FIG. 15 is a diagram illustrating one end surface in a direction intersecting with an insertion direction of the cartridge I. On the one end surface of the cartridge I, the supported portion 60*c*, a first boss 23Ia, a second boss 23Ib, and the rotated supported portion 60*d* are arranged in this order from the upstream side of the cartridge I. The developing unit 20 includes the protruding portion 20Aa protruding from the one end surface to one end side of the tray 18I. The first boss 23Ia and the second boss 23Ib are arranged in this order from a side of the protruding portion 20Aa in the direction orthogonal to the insertion direction E. The second exemplary embodiment is different from the first exemplary embodiment in which the second boss 23Ab and the first boss 23Aa are arranged in this order from the side of the protruding portion 20Aa in the direction orthogonal to the insertion direction E.

Next, a configuration related to the apparatus main body G will be described. According to the present exemplary embodiment, a movable member 201 is used that has a shape different from that of the movable member 101 according to the first exemplary embodiment. Thus, the movable member 201 is described with reference to FIGS. 16 and 17. FIG. 16 is a side view illustrating a state where the cartridge I is inserted to the tray 18I of the apparatus main body G.

Figure 17:
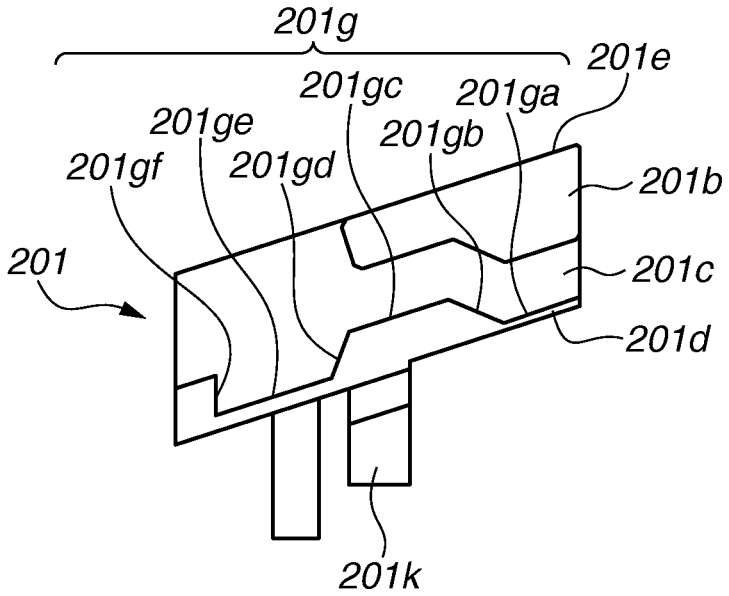
FIG. 17 is a schematic view illustrating a movable member provided in the tray according to the second exemplary embodiment.

As illustrated in FIG. 17, the movable member 201 includes a first engaging portion 201*b* and a second engaging portion 201*d* arranged in this order from the upper side. Thus, the first engaging portion 201*b* and the second engaging portion 201*d* form a second guide portion 201*c*.

An upper side of the first engaging portion 201*b* is an upper surface 201*e* having substantially the same inclined angle as the inclined surface 18Aa. A lower side of the first engaging portion 201*b* is a surface that is separated from the second engaging portion 201*d* by a constant distance.

As illustrated in FIG. 17, an upper side of the second engaging portion 201*d* is an upper surface portion 201*g* as in the case of the upper side of the first engaging portion 101*b* in the first exemplary embodiment. The upper surface portion 201*g* includes a first supporting surface 201*ga*, a first inclined surface 201*gb*, a second supporting surface 201*gc*, a second inclined surface 201*gd*, a third surface 201*ge*, and a regulating surface 201*gf* arranged in this order from the upstream side. The first supporting surface 201*ga* is formed in such a manner that the first boss 23Ia can enter a gap between the first supporting surface 201*ga* and the first engaging portion 201*b* at the first position X where the movable member 201 receives no force from the first and the second bosses 23Ia and 23Ib and is urged by the urging spring 104. The first supporting surface 201*ga* to be provided in the present exemplary embodiment may not be provided. The first inclined surface 201*gb* is inclined in such a manner that a portion of the first engaging portion 201*b* closer to the downstream end of the first supporting surface 201*ga* becomes more separated from the cover 103 in the direction intersecting with the insertion direction E. The second supporting surface 201*gc* has substantially the same inclined angle as the inclined surface 18Aa, on the downstream side of the first inclined surface 201*gb*. The second inclined surface 201*gd* leads to the downstream side of the second inclined surface 201*gc* and is inclined to be closer to the inclined surface 18Aa as it comes closer to the downstream end. Lastly, the regulating surface 201*gf* extends in the urging direction of the urging spring 104, on the downstream side of the second inclined surface 201*gd*. The second inclined surface 201*gd* and the regulating surface 201*gf* form a first recess portion 201*j*. While the third surface 201*ge* is provided which has substantially the same inclined angle as the inclined surface 18Aa and formed between the second inclined surface 201*gd* and the regulating surface 201*gf* according to the present exemplary embodiment, the third surface 201*ge* may not be formed.

An urged portion 201*k* is formed on a lower side of the movable member 201. The urging spring 104 is provided in the tray 18I in such a manner that the spring 104 pushes the urged portion 201*k* upward. The urging spring 104 is fixed to the tray 18I. As a result, when the cartridge I is not inserted to the tray 18I, that is, when the movable member 201 is at the first position X, the cover 103 provided on the upper side of the movable member 201 is in contact with the first engaging portion 201*b*.

An upstream part of a lower portion of the second engaging portion 201*d* overlaps a downstream part of a upper portion of the guide portion 18Ab so that a continuous structure is formed with which the cartridge I can be more stably inserted.

In the first exemplary embodiment, the protruding portion 20Aa of the cartridge A can pass through the gap between the inclined surface 18Aa and the guide portion 18Ab of the tray 18A even when the cartridge A is not inserted to the tray 18A, that is, even when the movable member 101 is at the first position X. In the present exemplary embodiment, the urged portion 201*k* is provided in such a manner that urged portion 201*k* blocks the gap between the inclined surface 18Aa and the guide portion 18Ab of the tray 18I through which the protruding portion 20Aa of the cartridge I passes when the movable member 101 is at the first position X. Thus, the erroneous attaching can be more effectively prevented. Additionally, in this case, a gap through which the protruding portion 20Aa of the cartridge I can pass is provided between the urged portion 201*k* and the second engaging portion 201*d* as in the first exemplary embodiment.

<Attaching of Cartridge I>

Similar to the first exemplary embodiment, in the present exemplary embodiment, the protruding portion 20Aa of the cartridge I is placed on the upstream side of the inclined surface 18Aa of the tray 18I, and on the other end, the bottom portion 20B of the cartridge I is placed on the upstream side of the inclined surface 18Ba. Then, the cartridge I is moved toward the downstream side. At this time, the protruding portion 20Aa can pass through the gap between the inclined surface 18Aa of the tray 18I and the guide surface 18Ac of the guide portion 18Ab. Thus, the movement of the tray 18I in the direction perpendicular to the inclined surface 18Aa is restricted, so that the position of the cartridge I becomes stable.

Figure 18A:
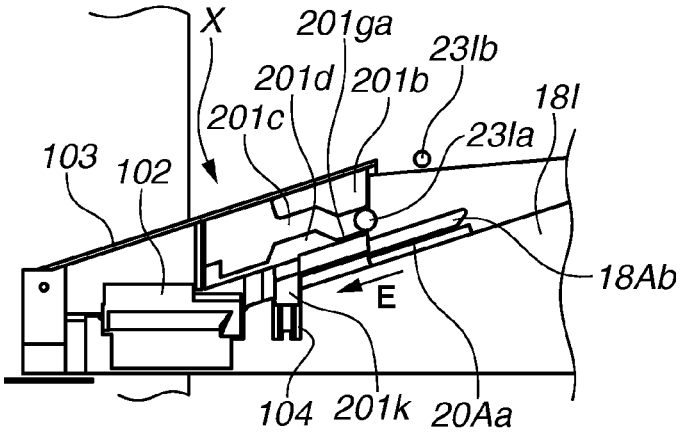
FIGS. 18A, 18B, 18C, and 18D are each a schematic view illustrating an operation of the movable member provided in the tray according to the second exemplary embodiment.

As illustrated in FIG. 18A, when the cartridge I further moves in the insertion direction E, the first boss 23Ia of the cartridge I enters the second guide portion 201*c*. FIG. 18A is a schematic view of the non-driving side of the movable member 201 in the first position X.

Figure 18B:
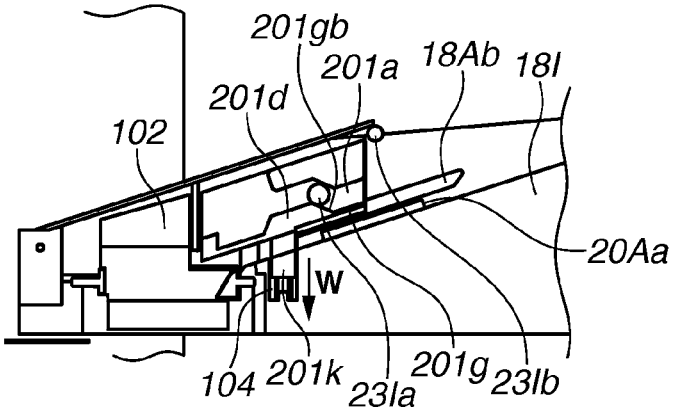

As illustrated in FIG. 18B, when the first boss 23Ia of the cartridge I enters the second guide portion 201*c*, the first boss 23Ia contacts with the second engaging portion 201*d*. Thus, the upper surface portion 201*g* of the second engaging portion 201*d* receives the force in the downward direction W from the first boss 23Ia, so that the movable member 201 moves in the downward direction W. More specifically, the cartridge I has the protruding portion 20Aa engaged with the guide portion 18Ab and thus, the upward movement of the cartridge I is regulated. On the other hand, after the first boss 23Ia passes through a portion of the second guide portion 201*c* which is formed between the first supporting surface 201*ga* and the first engaging portion 201*b*, the first boss 23Ia enters the second guide portion 201*c* which is partially formed by the first inclined surface 201*gb*. As a result, the first boss 23Ia contacts with the first inclined surface 201*gb*, so that the movable member 201 moves in the downward direction W against the urging force of the urging spring 104 that applies upward urging force.

Figure 18C:
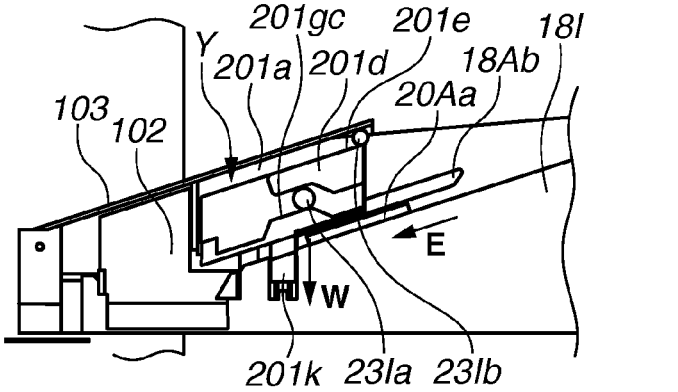

As illustrated in FIG. 18C, when the cartridge I further moves toward the downstream side, the first boss 23Ia reaches the second supporting surface 201*gc* of the second engaging portion 201*d*. At this time, the first boss 23Ia comes into contact with the second supporting surface 201*gc*. Then, the movable member 201 receives the force in the downward direction W from the first boss 23Ia, and is held at a incoming position as a result of moving in the downward direction W by a predetermined distance. More specifically, in the present exemplary embodiment, since the second supporting surface 201*gc* is in parallel with the inclined surface 18Aa, the movable member 201 is held at the second position Y after moving in the downward direction W by the predetermined distance. As a result, when the cartridge I moves toward the downstream side, the second boss 23Ib can enter the guide portion 201*a* formed between the cover 103 and the first engaging portion 201*b*. More specifically, the first engaging portion 201*b* which has been urged upward by the urging spring 104 to contact the cover 103 is separated from the cover 103, and the first guide portion 201*a* is formed between the cover 103 and the first engaging portion 201*b*. When the movable member 201 moves in the downward direction W, the urged portion 201*k*, which blocks the gap between the inclined surface 18Aa and the guide portion 18Ab of the tray 18I, is retracted, so that the protruding portion 20Aa of the cartridge I can pass through the gap. When the cartridge I further moves toward the downstream side, the second boss 23Ib of the cartridge I enters the first guide portion 201*a* of the movable member 201.

Figure 18D:
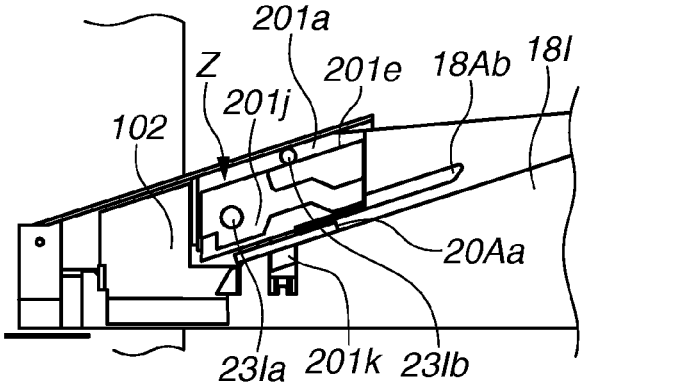

As illustrated in FIG. 18D, when the cartridge I further moves toward the downstream side, the first boss 23Ia reaches the first recess portion 201*j* of the second guide portion 201*c*. When the first boss 23Ia moves along the second inclined surface 201*gd* and the movable member 201 moves in the downward direction W by the predetermined distance, the upper surface 201*e* of the first engaging portion 201*b* comes into contact with the second boss 23Ib of the cartridge I. Thus, even when the first boss 23Ia is separated from the second inclined surface 201*gd*, the movable member 201 receives the force in the downward direction W from the second boss 23Ib and is held at the position to which the movable member 201 moves in the downward direction W by the predetermined distance. More specifically, in the present exemplary embodiment, since the upper surface 201*e* is in parallel with the inclined surface 18Aa, the movable member 201 is held at the third position Z to which the movable member 201 moves in the downward direction W by the predetermined distance. The cartridge I further moves toward the downstream side while the movable member 201 is being held by the second boss 23Ib. Thus, the first boss 23Ia passes through the second guide portion 201*c* without being caught by the regulating surface 201*gf*, and reaches a position where the first boss 23Ia overlaps the regulating portion 102*b* in the direction intersecting with the insertion direction E. When the cartridge I further moves toward the downstream side, the second boss 23Ib is separated from the first guide portion 201*a*.

Thereafter, with respect to the movable member 101, at least one of the first boss 23Ia and the second boss 23Ib comes in contact with the regulating portion 102*b* of the rotating member 102 in the longitudinal direction of the cartridge A, so that the regulating portion 102*b* is prevented from pivoting, as in the first exemplary embodiment. The rotating member 102 supports the movable member 201 coupled thereto and holds the movable member 201 at the fourth position V against the urging force of the urging spring 104.

The cartridge I, which is attached to the tray 18I, can be taken out by pulling the cartridge A toward the upstream side.

<Effect>

Thus, alternative patterns of the erroneous attaching prevention mechanism can be obtained by changing the position of the boss without expanding space for the movable member 101. The protruding portion 20Aa of the cartridge I can pass through the gap when the urged portion 201*k* of the movable member 201 is moved. Thus, as in the first exemplary embodiment, the erroneous attaching can be surely prevented regardless of the attaching orientation. The second boss 23Ib to be provided in the second exemplary embodiment may not be provided.

Next, a third exemplary embodiment of the present invention will be described in detail with reference to FIGS. 19 to FIGS. 22A and 22B. In the present exemplary embodiment, portions different from the exemplary embodiments described above will be described in detail. The materials and the shapes are similar to those in the exemplary embodiments described above unless otherwise specified. These common portions are denoted with the same reference numerals and will not be described in detail.

Figure 19:
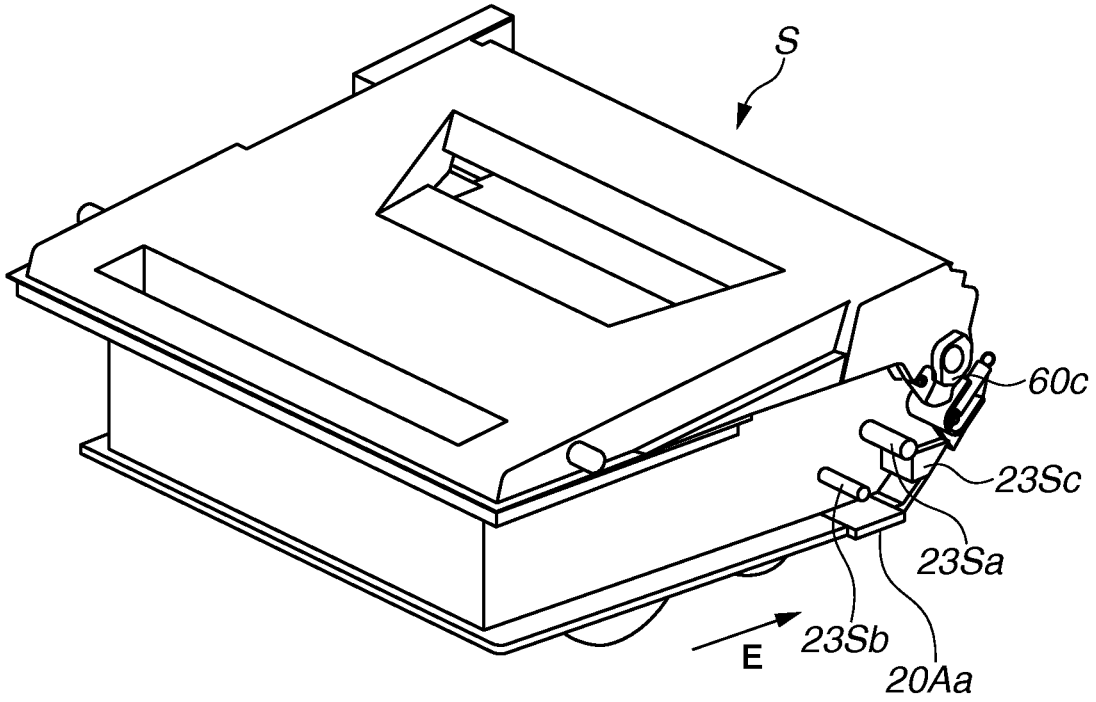
FIG. 19 is a perspective view of an end surface on a non-driving side of a cartridge according to a third exemplary embodiment.

A configuration related to a cartridge S will be described in detail with reference to FIG. 19. FIG. 19 is a diagram illustrating one end surface in a direction intersecting with an insertion direction of the cartridge S. On the one end surface of the cartridge S, the supported portion 60*c*, a regulating portion 23Sc, a first boss 23Sa, a second boss 23Sb, and the rotated supported portion 60*d* are arranged in this order from the upstream side of the cartridge S. The developing unit 20 includes the protruding portion 20Aa protruding from one end surface to one end side of a tray 18S. The third exemplary embodiment is different from the first exemplary embodiment in that the regulating portion 23Sc is provided.

Figure 20A:
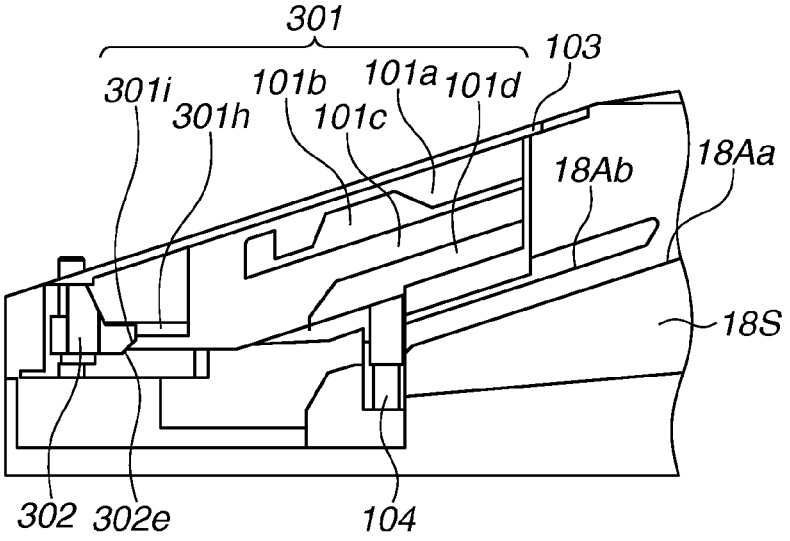
FIGS. 20A, 20B, and 20C are each a cross-sectional side view of an erroneous attachment prevention mechanism according to the third exemplary embodiment.
Figure 20B:
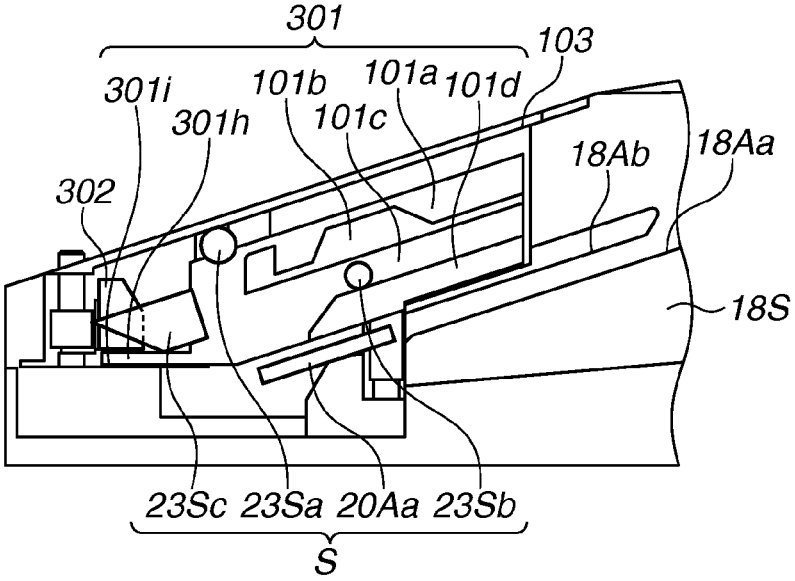
Figure 20C:
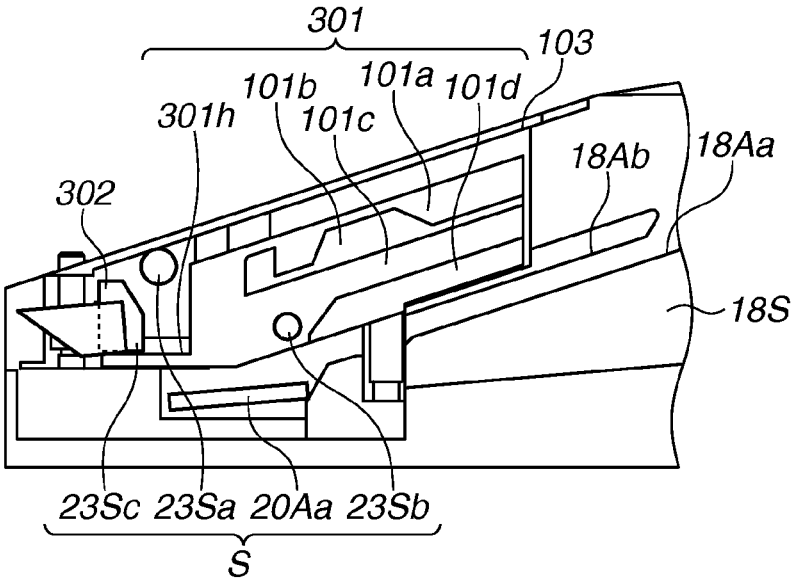

Next, a configuration related to the apparatus main body G will be described. In the present exemplary embodiment, a rotating member 302 is used that has a different shape from the rotating member 102 according to the first exemplary embodiment. Thus, the rotating member 302 and a relationship between the rotating member 302 and a movable member 301 will be described below with reference to FIGS. 20A, 20B, and 20C to FIGS. 22A and 22B. FIGS. 20A, 20B, and 20C are each a side view illustrating a state where a cartridge S is inserted into the tray 18S of the apparatus main body G.

As illustrated in FIGS. 20A, 20B, and 20C, the movable member 301 includes the first engaging portion 101*b* and the second engaging portion 101*d* that are arranged in this order from the upper side, as in the first exemplary embodiment. Thus, the cover 103 above the movable member 101 and the first engaging portion 101*b* form the first guide portion 101*a*. The first guide portion 101*a* is formed in such a manner that the first boss 23Sa of the cartridge S can enter the first guide portion 101*a* when the movable member 301 moves. The first engaging portion 101*b* and the second engaging portion 101*d* form a second guide portion 101*c*. The second guide portion 101*c* is formed in such a manner that the second boss 23Sb of the cartridge S can enter the second guide portion 101*c* when the movable member 101 moves. The movable member 301 includes a protruding portion 301*h* extending toward the downstream side. An engaging portion 301*i* that engages with the rotating member 302 is provided in the protruding portion 301*h*.

Figure 21:
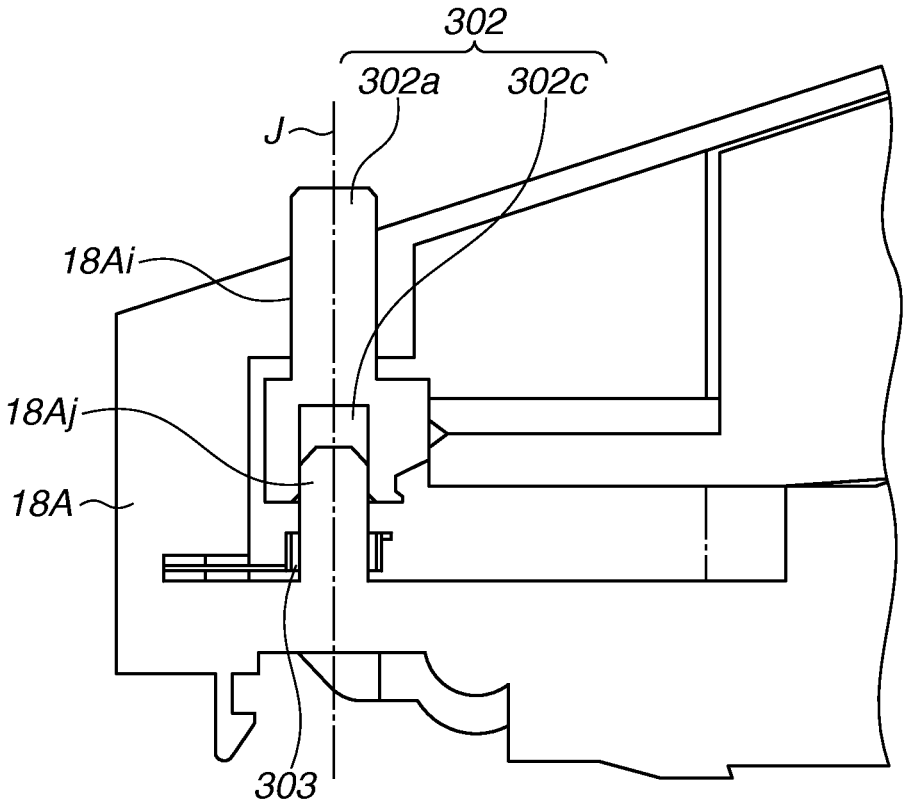
FIG. 21 is a cross sectional view of a portion of the erroneous attachment prevention mechanism according to the third exemplary embodiment around a rotational axis.
Figure 22A:
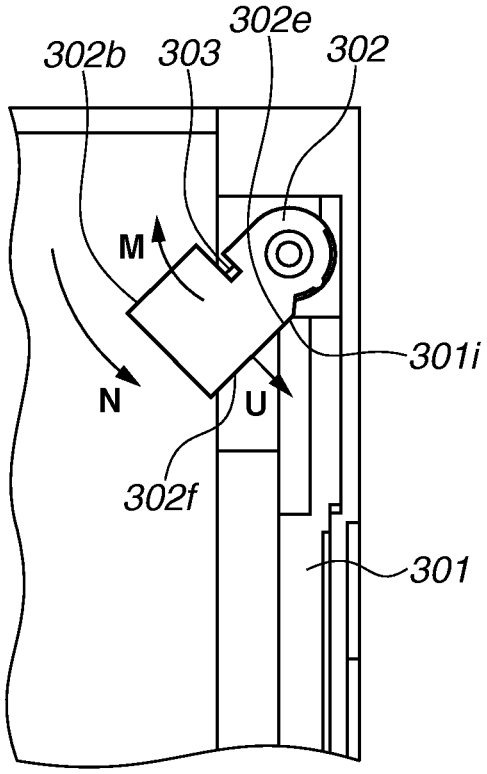
FIGS. 22A and 22B are each a top view of the erroneous attachment prevention mechanism according to the third exemplary embodiment.
Figure 22B:
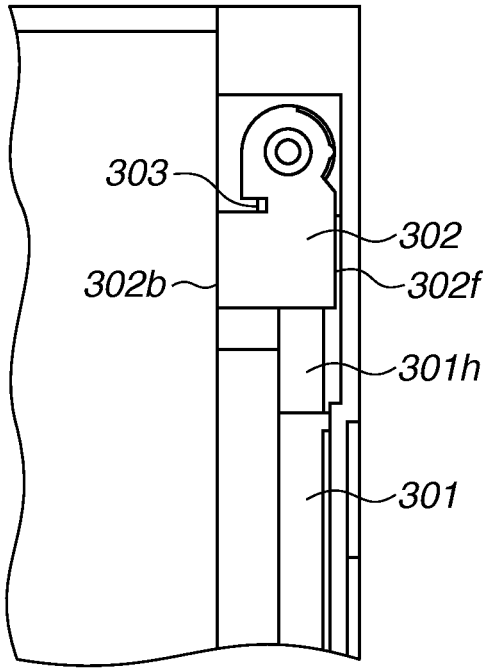
Figure 23:
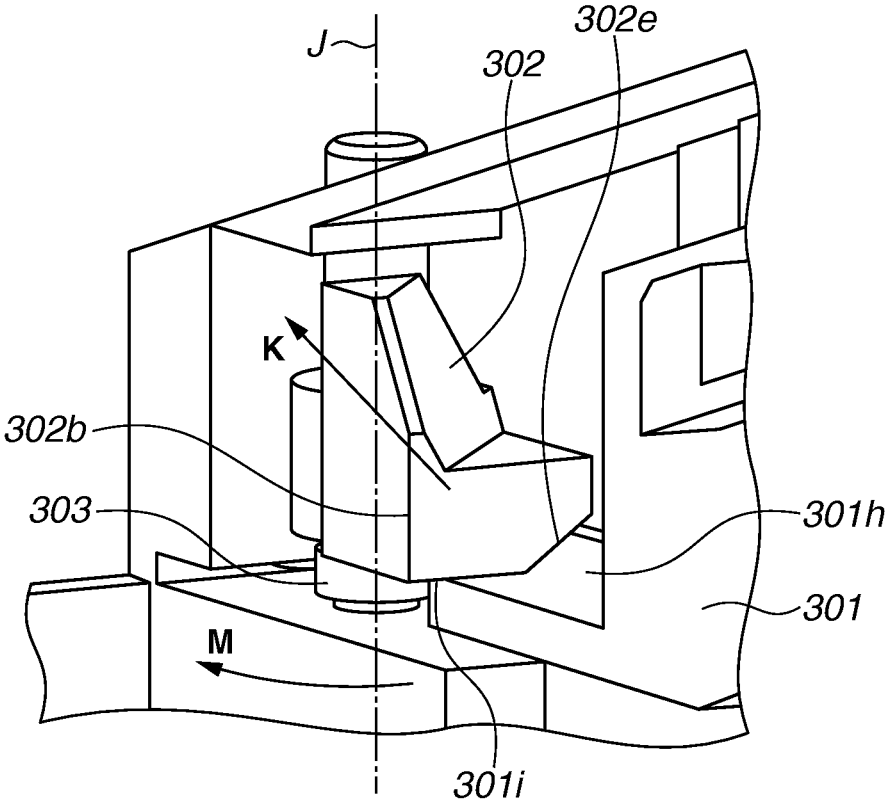
FIG. 23 is a schematic view illustrating an operation of a rotating member provided in a tray according to the third exemplary embodiment.

FIG. 21 is a cross-sectional view around the rotational center J of the pivoting member 302, as viewed from the driving side direction. FIGS. 22A and 22B are each a top view illustrating a portion around the movable member 301. FIG. 23 is a perspective view of the pivoting member 302 and the movable member 301 at the retracted position. The rotating member 302 includes a shaft portion 302*a*, a hole portion 302*c*, a contact portion 302*b*, an inclined surface 302*e*, and an engagement surface 302*f*. The shaft portion 302*a* and the hole portion 302*c* respectively disposed in upper and lower end portions of the rotating member 302, respectively engage with a hole portion 18Ai and a shaft portion 18Aj of the tray 18A, to be supported by the tray 18A rotatable about the rotational center (rotational axis) J. As described above, the rotating member 302 has the rotational center (rotational axis) J intersecting with the insertion direction E.

When the cartridge S is not inserted into the tray 18A, that is, when the movable member 301 is at the first position X, as illustrated in FIG. 20A, the engagement surface 302*f* of the rotating member 302 protrudes beyond the movable member 301 toward the driving side (center side in the longitudinal direction). At this time, as illustrated in FIGS. 22A and 22B, the engagement surface 302*f* contacts the engaging portion 301*i* of the movable member 301.

The rotating member 302 includes a urging member 303, that is, a torsion coil spring in the present exemplary embodiment. The rotating member 302 receives urging force in a direction indicated by an arrow U from the urging member 303. The urging force U of the urging member 303 which is applied to the rotating member 302 is received by the engaging portion 301*i* of the movable member 301, and the rotating member 302 is held protruding beyond the movable member 301 toward the driving side. More specifically, the engagement surface 302*f* protrudes to a position to contact the cartridge S, and thus partially blocks an entrance path of the cartridge S.

<Attaching of cartridge S>

As in the first exemplary embodiment, also in the present exemplary embodiment, the protruding portion 20Sa of the cartridge S is placed on the upstream side of the inclined surface 18Aa of the tray 18A, while, on the other end, the bottom portion 23B of the cartridge S is placed on the upstream side of an inclined surface 18Ba. When the cartridge S moves toward the downstream side, the cartridge S can pass through the gap between the inclined surface 18Aa of the tray 18S and the guide surface 18Ac of the guide portion 18Ab. As a result, the movement of the cartridge S in a direction perpendicular to the inclined surface 18Aa of the tray 18A is restricted and the position of the cartridge S becomes stable.

When the cartridge S further moves toward the downstream side, the first boss 23Sa of the cartridge S enters the first guide portion 101*a*. When the first boss 23Sa of the cartridge S enters the first guide portion 101*a*, the first engaging portion 101*b* receives the force in the downward direction W from the first boss 23Sa, so that the movable member 301 moves in the downward direction W (the second position Y). As illustrated in FIG. 20B, while the first boss 23Sa is passing through the first guide portion 101*a* (third position Z), the second boss 23Sb enters the second guide portion 101*c*. The second boss 23Sb is brought into contact with the second guide portion 101*c* or the first boss 23Sa is brought into contact with the first engaging portion 101*a*, so that the movable member 301 moves in the downward direction W against the upward urging force of the urging spring 104.

At this time, as illustrated in FIG. 23, the engaging portion 301*i*, which is provided in the protruding portion 301*h* of the movable member 301, moves in the downward direction beyond the engagement surface 302*f* of the rotating member 302. Thus, the engaging portion 301*i* of the movable member 301 is separated from the engaging portion 302*f* of the rotating member 302. Accordingly, the urging force U of the urging member 303 makes the rotating member 302 pivot about the rotational center J in the direction indicated by the arrow N. Thus, the rotating member 302 is retractable to a retract position so as not to abut on the cartridge A in the insertion direction E, so that the cartridge S can be attached to the tray 18A.

As illustrated in FIG. 20C, when the cartridge S further moves toward the downstream side, the first boss 23Sa is separated from the first engaging portion 101*a*, and the second boss 23Sb is separated from the second guide portion 101*c*. Thus, the movable member 301 is urged upward by the urging spring 104. As a result, the urging force U of the urging member 303 is not received by the engaging portion 301*i* of the movable member 301, and the rotating member 302 attempts to move to protrude toward the driving side. At this time, the contact portion 302*b* of the movable member 302 contacts the regulating portion 23Sc provided on the non-driving side of the cartridge S in the longitudinal direction, so that the pivoting surface 302*b* is prevented from pivoting in the direction indicated by the arrow M. Thus, the rotating member 302 holds the movable member 301 coupled thereto at the fourth position V against the urging force of the urging spring 104. In such a manner, the rotating member 302 is held at the retract position. The cartridge S attached to the tray 18S can be taken out by pulling the tray 18S toward the upstream side of the cartridge S.

When the cartridge S is pulled out from the tray 18S, the movable member 301 is moved upward by the urging force of the urging spring 104. At this time, when the movable member 301 moves upward, the inclined surface 302*e* of the rotating member 302 receives force in a direction indicated by an arrow K perpendicular to the inclined surface 302*e* from the engaging portion 301*i* of the movable member 301. The rotating member 302 pivots in the direction indicated by the arrow M (FIG. 23) about the rotational center J against the urging force from the urging member 303. Then, as illustrated in FIG. 20A, the rotating member 302 returns to a position where the rotating member 302 protrudes beyond the movable member 301 toward the driving side. Thus, as in the first exemplary embodiment, the rotating member 302 protrudes to a position where it abuts on the incompatible cartridge inserted to the tray 18S, to partially close the entrance path. Accordingly, the incompatible cartridge can be prevented from being erroneously attached.

<Effect>

As described above, the erroneous attaching can be surely prevented without expanding the space for the rotating member 302 as in the first exemplary embodiment.

The scope of the present invention is not limited to functions, materials, shapes, positional relationships, and the like of the components described in the exemplary embodiments described above, unless otherwise specified.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-210226, filed Oct. 14, 2014, which is hereby incorporated by reference herein in its entirety.

What is claimed is:

1. An image forming apparatus in which a cartridge is insertable to an attached position, the image forming apparatus comprising:

the cartridge including an protruding portion, extending in an insertion direction of the cartridge, and a boss;

a frame;

a guide surface provided in the frame on which the extending portion is placed;

a guide portion provided in the frame, configured to form a gap with the guide surface through which the extending portion is able to pass therethrough; and a movable member, including a pushed portion which comes into contact with the boss, configured on a downstream side of the guide portion in the insertion direction, wherein, the movable member moves in a direction intersecting with the insertion direction by the boss comes into contact with the pushed portion so as to enable the cartridge to move along the guide surface for the attached position.

2. The image forming apparatus according to claim 1, wherein the frame includes a tray which can be pulled out and to which the cartridge is detachably attached, and wherein the guide surface and the movable member are provided in the tray.

3. The image forming apparatus according to claim 1, wherein the guide surface is inclined with a horizontal plane.

4. An image forming apparatus in which a cartridge is insertable to an attached position, the image forming apparatus comprising:

the cartridge including an extending portion, extending in an insertion direction of the cartridge, and a first boss and a second boss, a frame;

a guide surface provided in the frame on which the extending portion is placed;

a guide portion provided in the frame, configured to form a gap with the guide surface through which the extending portion is able to pass therethrough; and a movable member, including a first pushed portion which comes in contact with the first boss, configured to be moveable in a direction intersecting with the insertion direction on a downstream side of the guide portion in the insertion direction.

wherein the movable member moves to enable the second boss to pass the movable member by the first boss comes into contact with the first pushed portion, so that the cartridge is enabled to move along the guide surface for the attached position.

5. The image forming apparatus according to claim 4, wherein the movable member includes a second pushed portion which comes in contact with the second boss on the downstream side of the guide portion in the insertion direction, and wherein the second boss enters a gap between the first pushed portion and the second pushed portion by the first boss comes into contact with the first pushed portion, so that the cartridge is enabled to move along the guide surface for the attached position.

6. The image forming apparatus according to claim 4, wherein the frame includes a tray which can be pulled out and to which the cartridge is detachably attached, and wherein the guide surface and the movable member are provided in the tray.

7. The image forming apparatus according to claim 4, wherein the guide surface is inclined with a horizontal plane.

8. An image forming apparatus in which a cartridge is insertable to an attached position, the image forming apparatus comprising:

the cartridge including an extending portion, extending in an insertion direction of the cartridge, and a boss;

a frame;

a guide surface provided in the frame on which the extending portion is placed;

a guide portion provided in the frame, configured to form a gap with the guide surface through which the extending portion is able to pass therethrough;

a movable member, including a pushed portion which comes into contact with the boss, which is movable in a direction intersecting with the insertion direction, configured on a downstream side of the guide portion in the insertion direction; and a pivoting member configured to pivot in conjunction with the movement of the movable member, wherein the pivoting member moves from a position where the pivoting member interferes with the cartridge in the insertion direction to a retract position where the cartridge can be attached to the attached position.

9. The image forming apparatus according to claim 8, wherein the pivoting member has a rotational axis intersecting with the insertion direction, and wherein the pivoting member can be retracted to the retract position by rotating about the rotational axis.

10. The image forming apparatus according to claim 8, wherein the frame includes a tray which can be pulled out and to which the cartridge is detachably attached, and wherein the guide surface and the movable member are provided in the tray.

11. The image forming apparatus according to claim 8, wherein the guide surface is inclined with a horizontal plane.

12. The image forming apparatus according to claim 1, wherein the extending portion protrudes outside as compared with a surface where the boss protrudes.

13. The image forming apparatus according to claim 4, wherein the second boss enables to pass a groove of the movable member.

14. The image forming apparatus according to claim 4, wherein the second boss enables to pass a space before the movable member moved by the first boss.

* * * * *